US009091949B2

(12) United States Patent
Yu et al.

(10) Patent No.: US 9,091,949 B2
(45) Date of Patent: Jul. 28, 2015

(54) IMAGING MEMBERS HAVING ELECTRICALLY AND MECHANICALLY TUNED IMAGING LAYERS

(71) Applicant: XEROX CORPORATION, Norwalk, CT (US)

(72) Inventors: Robert C. U. Yu, Webster, NY (US); Stephen T. Avery, Rochester, NY (US); Jimmy E. Kelly, Rochester, NY (US); Mark Muscato, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 40 days.

(21) Appl. No.: 13/969,314

(22) Filed: Aug. 16, 2013

(65) Prior Publication Data

US 2015/0050587 A1 Feb. 19, 2015

(51) Int. Cl.
*G03G 5/047* (2006.01)
*G03G 5/07* (2006.01)

(52) U.S. Cl.
CPC ..... *G03G 5/071* (2013.01)

(58) Field of Classification Search
CPC ... G03G 5/0614; G03G 5/047; G03G 5/0661; G03G 5/14704; G03G 5/14791; G03G 5/14708
USPC ..... 430/58.05, 66
See application file for complete search history.

(56) References Cited

U.S. PATENT DOCUMENTS 3,121,006 A 2/1964 Middleton et al.
3,820,989 A 9/1969 Rule et al.
3,837,851 A 9/1974 Shattuck et al.
3,895,944 A 7/1975 Wiedemann et al.
4,150,987 A 4/1979 Anderson et al.
4,245,021 A 1/1981 Kazami et al.
4,256,821 A 3/1981 Enomoto et al.
4,265,990 A 5/1981 Stolka et al.
4,278,746 A 7/1981 Goto et al.
4,286,033 A 8/1981 Neyhart et al.
4,291,110 A 9/1981 Lee
4,297,426 A 10/1981 Sakai et al.
4,315,982 A 2/1982 Ishikawa et al.
4,338,387 A 7/1982 Hewitt
4,338,388 A 7/1982 Sakai et al.
4,385,106 A 5/1983 Sakai
4,387,147 A 6/1983 Sakai
4,399,207 A 8/1983 Sakai et al.
4,399,208 A 8/1983 Takasu et al.
4,587,189 A 5/1986 Hor et al.
4,664,995 A 5/1987 Horgan et al.

(Continued)

OTHER PUBLICATIONS

Damodar M. Pai, et al., U.S. Appl. No. 10/655,882, filed Sep. 5, 2003, now Patent No. 7,018,756, Issued Mar. 28, 2006.

*Primary Examiner* — Hoa V Le

(74) *Attorney, Agent, or Firm* — Pillsbury Winthrop Shaw Pittman LLP

(57) ABSTRACT

An electrophotographic imaging member which has improved imaging layer(s) formulated to comprise a charge transport compound and a polymer blended binder to render photoelectrical stability, tune-ability, and surface contact friction reduction for providing service life extension. The polymer blended binder used in the imaging layer(s) is a binary polymer blend consisting of: (1) an A-B diblock copolymer and a bisphenol polycarbonate and (2) an A-B diblock copolymer and a bisphenol polycarbonate plus a slippery nano POSS particle dispersion in its material matrix.

10 Claims, 7 Drawing Sheets

(56) References Cited

U.S. PATENT DOCUMENTS

| | | | | |
|---|---|---|---|---|
| 4,988,597 | A | 1/1991 | Spiewak et al. | |
| 5,215,839 | A | 6/1993 | Yu | |
| 5,244,762 | A | 9/1993 | Spiewak et al. | |
| 5,660,961 | A | 8/1997 | Yu | |
| 5,697,024 | A | 12/1997 | Mishra | |
| 5,703,487 | A | 12/1997 | Mishra | |
| 5,756,245 | A | 5/1998 | Esteghamatian et al. | |
| 5,958,638 | A | 9/1999 | Katayama et al. | |
| 6,008,653 | A | 12/1999 | Popovic et al. | |
| 6,119,536 | A | 9/2000 | Popovic et al. | |
| 6,124,514 | A | 9/2000 | Emmrich et al. | |
| 6,150,824 | A | 11/2000 | Mishra et al. | |
| 6,214,514 | B1 | 4/2001 | Evans et al. | |
| 6,326,111 | B1 | 12/2001 | Chambers et al. | |
| 6,756,169 | B2 | 6/2004 | Lin et al. | |
| 6,933,089 | B2 | 8/2005 | Horgan et al. | |
| 7,018,756 | B2 | 3/2006 | Pai et al. | |
| 7,033,714 | B2 | 4/2006 | Horgan et al. | |
| 7,413,835 | B2 | 8/2008 | Lin et al. | |
| 7,592,111 | B2 | 9/2009 | Yu et al. | |
| 2009/0253058 | A1* | 10/2009 | Yu et al. | 430/58.8 |
| 2011/0207038 | A1* | 8/2011 | Yu et al. | 430/56 |
| 2011/0305981 | A1* | 12/2011 | Yu et al. | 430/56 |
| 2012/0219893 | A1* | 8/2012 | Yu et al. | 430/58.8 |

* cited by examiner

IMAGING MEMBERS HAVING ELECTRICALLY AND MECHANICALLY TUNED IMAGING LAYERS

BACKGROUND

The presently disclosed embodiments relate in general to electrostatography comprising improved features in the imaging member that enhance functional properties when used in the electrostatographic imaging system. These embodiments pertain to, more particularly, an electrophotographic imaging member which has improved imaging layer(s) formulated to comprise a charge transport compound and a novel polymer blended binder. The novel polymer blended binder used in the imaging layer(s) is a binary polymer blend as described herein to give two distinctive binder blended formulations and properties.

The three polymer blended binder formulations are: (1) a binary polymer blended binder formed to consist of blending a film forming bisphenol polycarbonate and a film forming organic acid terminated A-B diblok copolymer to impart imaging member photoelectrical tune-ability result, (2) a binary polymer blended binder formed to consist of a blend of the film forming bisphenol polycarbonate and the organic acid terminated A-B diblock copolymer plus a slippery nano size silicon oxide particle dispersion to render the resulting imaging member surface lubricity for contact friction reduction and photoelectrical tune-ability/wear resistance enhancement, and (3) a binary polymer blended binder formed to consist of blending the film forming organic acid terminated A-B diblock copolymer and a polysiloxane containing low surface energy copolymer to impart imaging member photoelectrical stability as well as surface adhesiveness/slipperiness/contact friction reduction. In the present disclosure, slipperiness refers to a property of cleaning apparatus or machine contacting subsystems that allows such apparatus or subsystems contacting the imaging member to easily slide over the surface. Adhesiveness is the opposite of adhesion, namely, that material contact on the surface does not stick to the surface but is rather easily removed.

The novel polymer blended binders formulated according to the description in the embodiments of present disclosure provide the resulting imaging member with specific benefits of photo-electrical tune-ability, copy printout quality improvement, chemical amine contaminant protection, as well as surface energy lowering result for contact friction reduction. The imaging layer(s), for example the charge transport layer(s), formulated as described herein are applicable for all types of electrophotographic imaging members used in electrophotography to provide effective imaging member service life extension in the field.

In electrophotographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Typical electrophotographic imaging members include, for example: photoreceptors commonly utilized in electrophotographic (xerographic) imaging process systems. All of the electrophotographic imaging members are prepared in either flexible belt form or rigid drum configuration. For typical flexible electrophotographic imaging member belt, it comprises a charge transport layer, a charge generating layer, and optional layers on one side of a flexible supporting substrate layer and does also include application of an anticurl back coating on the opposite side of the substrate to render imaging member flatness and complete the imaging member structure. Alternatively, the electrophotographic imaging members can also be prepared as rigid member, such as those utilizing a rigid substrate support drum. For these drum imaging members, having a thick rigid cylindrical supporting substrate bearing the imaging layer(s), there is no exhibition of the curl-up problem, and thus, there is no need for an anticurl back coating layer.

The flexible electrophotographic imaging members may be seamless or seamed belts. Seamed belts are usually formed by cutting a rectangular sheet from a web, overlapping opposite ends, and welding the overlapped ends together to form a welded seam.

Although the scope of the present embodiments covers the preparation of both types of electrophotographic imaging members, in either flexible belt design or rigid drum configuration, for reasons of simplicity, the discussion hereinafter will focus only on flexible electrophotographic imaging member belts.

One type of flexible composite photoconductive layer used in xerography is illustrated in U.S. Pat. No. 4,265,990 which describes a photosensitive imaging member having at least two electrically operative layers. One layer comprises a photoconductive layer which is capable of photogenerating holes and injecting the photogenerated holes into a contiguous charge transport layer. Generally, the two electrically operative layers are supported on a conductive layer support substrate, with the photoconductive layer being sandwiched between a contiguous charge transport layer and the supporting conductive layer. In this negatively charged imaging member, the charge transport layer is the top outermost exposed layer. In the alternative imaging member design, the charge transport layer is, however, sandwiched between the supporting electrode and a photoconductive layer. Since the typical flexible electrophotographic imaging members exhibit undesirable upward imaging member curling-up after completion of the electrically operative layers, the application of an anticurl back coating onto the backside of the support substrate is necessary to provide the appropriate imaging members with desirable flatness.

The flexible photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

In the case where the charge generating layer is sandwiched between the top outermost exposed charge transport layer and the electrically conducting layer, the outer surface of the charge transport layer is charged negatively and the conductive layer is charged positively. The charge generating layer then should be capable of generating electron hole pair when exposed image wise and inject only the holes through the charge transport layer. In the alternate case when the charge transport layer is sandwiched between the charge generating layer and the conductive layer, the outer surface of the charge generating layer is charged positively while conductive layer is charged negatively and the holes are injected through from the charge generating layer to the charge transport layer. The charge transport layer should be able to transport the holes with as little trapping of charge as possible. In flexible imaging member belt such as photoreceptor, the charge conductive layer may be a thin coating of metal on a flexible substrate support layer.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements including narrow operating limits on photoreceptors. For example, the numerous layers used in many modern photoconductive imaging members should be highly flexible, adhere well to adjacent layers, and exhibit predictable electrical characteristics within narrow operating limits to provide excellent toner images over many thousands of cycles. Typically, negatively charged multilayered flexible photoreceptor that has been employed as a belt in electrophotographic imaging systems comprises a flexible substrate, a conductive layer, an optional blocking layer, an optional adhesive layer, a charge generating layer, a charge transport layer and a conductive ground strip layer adjacent to one edge of the imaging layers. In such a photoreceptor, it does usually further comprise an anticurl back coating layer on the backside of the substrate (opposite the side carrying the conductive layer, support layer, blocking layer, adhesive layer, charge generating layer, charge transport layer, and other layers) to effect curl control for rendering flatness configuration and give a complete structure.

Since the charge transport layer in a negatively charged imaging member is the top outermost exposed layer, it is constantly subjected to machine cleaning blade and cleaning mechanical friction interaction brush under a normal machine electrophotographic imaging and cleaning processes condition, the charge has been found to develop pre-mature wear/scratch failure. In addition, the outer Charge transport layer is also exposed to chemical vapor contaminants interaction during electrophotographic imaging process in the field to negatively impact function. For example, exposure to the vapor amine species (from ammonia) emitted from common cleaning agents have been seen to interact with the imaging member charge transport layer, causing material degradation to promote pre-mature onset of charge transport layer cracking and exacerbation of wear failure which severely cut short the functional life of the imaging member. In one particular instant, amine vapor impact on copy printout quality degradation has recently been seen when pre-printed papers (papers having pre-printed images which employed amine agents catalyzed UV cured ink) are used by customers for subsequent addition of xerographic images over the pre-printed paper blank spaces; that is the accumulation of amine residues deposition onto the imaging member charge transport layer surface, after repeatedly making contact with receiving papers during xerographic imaging process, is found to cause ghosting image defects print-out in the output copies. Since ghosting image defects in the output copies are unacceptable print quality failures, so it does require frequent costly imaging member replacement in the field.

Additionally, the conventional flexible imagine member designs have an inherent photo-electrical function limitation; which is exhibition of progressive electrical property degradation of monotonously cycle-up under a normal machine electrophotographic imaging process condition. The continuation of imaging member electrical cyclic up is seen to gradually reach a point of onset of copy print failure that cuts short the imaging member service life.

With the issues described above, there is an urgent need to resolve these issues and extend the service life of the imaging member in the field. In particular, there is a need for a formulation of a charge transport layer that is resistive to amine specific effect to resolve the current pre-printed paper ghosting image defects print out problem.

Conventional photoreceptors are disclosed in the following patents, a number of which describe the presence of light scattering particles in the undercoat layers: U.S. Pat. No. 5,660,961; U.S. Pat. No. 5,215,839; and U.S. Pat. No. 5,958,638. The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

In U.S. Pat. No. 7,413,835, there is disclosed an electrophotographic imaging member having a thermoplastic charge transport layer, a polycarbonate polymer binder, a particulate dispersion, and a high boiler compatible liquid. The disclosed charge transport layer exhibits enhanced wear resistance, excellent photoelectrical properties, and good print quality.

In U.S. Pat. No. 7,592,111, issued on Sep. 22, 2009 to Yu, et al., there is disclosed an imaging member formulated with a crosslinkable liquid carbonate for charge transport layer and overcoat layer binder formulation. The imaging electrostatographic member exhibits improved service life.

SUMMARY

In the present embodiments, there is provided a flexible imaging member comprising: a flexible substrate; a charge generating layer disposed on a first side of the substrate; and at least one charge transport layer disposed on the charge generating layer, wherein the charge transport layer comprises a charge transport compound molecularly dispersed or dissolved in a binary polymer blend binder to form a solid solution, the polymer blend binder comprising a bisphenol polycarbonate and an organic acid containing A-B diblock copolymer having a general formula of $$R_1\text{-}(\text{[Block A]}_z\text{-[Block B]}_y)_n\text{OH}$$

wherein block A is a polycarbonate repeating unit, block B is an organic acid containing repeating unit, z is from about 9 to about 54, y is from about 1 to about 6, n is between about 20 and about 80, and $R_1$ is H or $CH_3$.

In further embodiments, there is provided a flexible imaging member comprising: a flexible substrate; a charge generating layer disposed on a first side of the substrate; and at least one charge transport layer disposed on the charge generating layer, wherein the charge transport layer comprises a charge transport compound molecularly dispersed or dissolved in a binary polymer blend binder to form a solid solution, the binary polymer blend binder comprising a bisphenol polycarbonate and an organic acid terminated A-B diblock copolymer, wherein the bisphenol polycarbonate present in the binary polymer blend binder has a molecular formula selected from the group consisting of:

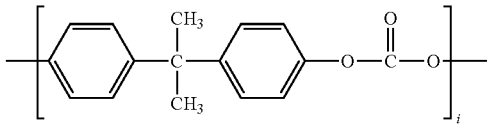

wherein i is degree of polymerization is of between 20 and 80, and

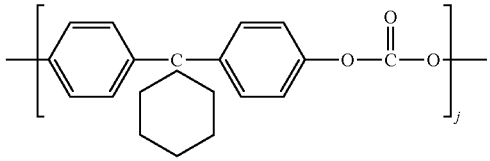

wherein j is the degree of polymerization and is a positive integer of between about 50 and about 200, and the A-B diblock copolymer is selected from the group consisting of

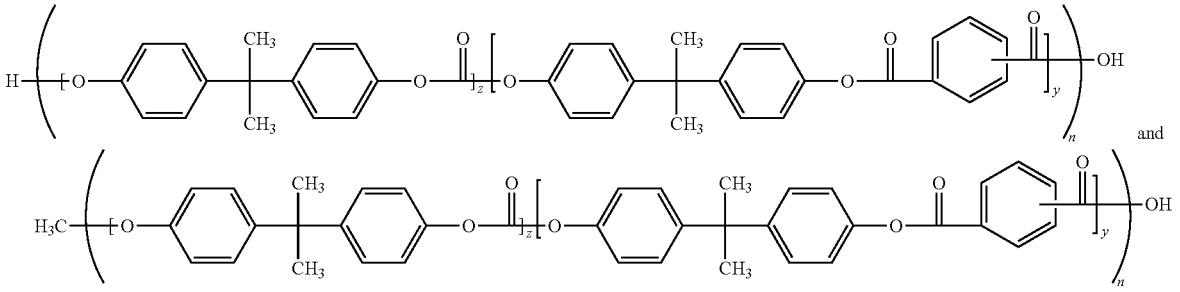

and wherein z represents the number of bisphenol A repeating units in segmental block (A) of from about 9 to about 18, y is number of repeating phthalic acid segmental block (B) of from about 1 to about 2, and n is the degree of polymerization and is between about 20 and about 90.

In yet further embodiments, there is provided an image forming apparatus for forming images on a recording medium comprising: a) an imaging member having a charge retentive-surface for receiving an electrostatic latent image thereon, wherein the imaging member comprises a substrate, a charge generation layer, at least one charge transport layer disposed on the charge generation layer, wherein the charge transport layer comprises a charge transport compound molecularly dispersed or dissolved in a binary polymer blend binder to form a solid solution, the polymer blend binder comprising a bisphenol polycarbonate and an organic acid containing A-B diblock copolymer having a general formula of $$R_1\text{-}(\text{[Block A]}_z\text{-[Block B]}_y)_n\text{OH}$$

wherein block A is a polycarbonate repeating unit, block B is an organic acid containing repeating unit, z is from about 9 to about 54, y is from about 1 to about 6, n is between about 20 and about 80, and $R_1$ is H or $CH_3$; b) a development component for applying a developer material to the charge-retentive surface to develop the electrostatic latent image to form a developed image on the charge-retentive surface; c) a transfer component for transferring the developed image from the charge-retentive surface to a copy substrate; and a fusing component for fusing the developed image to the copy substrate.

BRIEF DESCRIPTION OF THE DRAWINGS

For a better understanding of the details of present disclosure, reference may be had to the accompanying figures.

DETAILED DESCRIPTION

Figure 1:
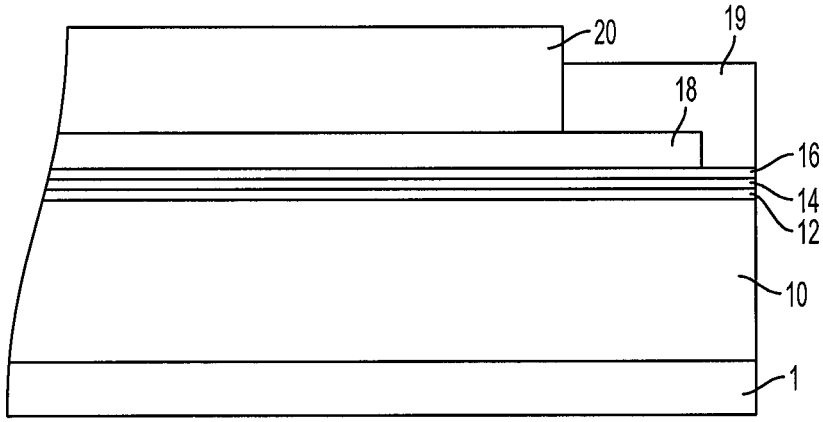
FIG. 1 is a cross-sectional view of a conventional flexible multilayered electrophotographic imaging member.

In the following description, reference is made to the accompanying drawings, which form a part hereof and which illustrate several embodiments. It is understood that other embodiments may be utilized and material formulation re-designed/modifications and operational changes may be made without departure from the scope of the present embodiments.

According to aspects illustrated herein, there is provided negatively charged flexible imaging members prepared to use two distinctive polymer blended binary binder designs in the formulation of charge transport layer(s), so that the charge transport layer(s) as formulated provides the resulting imaging members with photoelectrical tune-ability and photoelectrical stability as well as lower surface energy to effect contact friction reduction and facilitate toner image paper transfer efficiency.

In embodiments, the imaging member of the present disclosure has photoelectrical tune-ability. In these embodiments, the flexible electrophotographic imaging member is comprised of a flexible substrate, a charge generating layer disposed on the substrate, and at least one charge transport layer disposed on the charge generating layer, and an anticurl back coating applied to the opposite side of the substrate to render imaging member flatness. The charge transport layer prepared according to the present disclosure comprises a charge transport compound molecularly dispersed or dissolved in a polymer blended binder consisting of a film forming polycarbonate and a film forming high molecular weight organic acid containing A-B diblock copolymer to provide chemical amine protection. As used herein, being molecularly dispersed or dissolved means that the charge transport compound is intertwined with and incorporated into the polymer blend on a molecular level. The charge transport compound and polymer blend form a solid solution. In specific embodiments, the disclosed charge transport layer in the flexible electrophotographic imaging member is formulated to comprise a charge transport compound of N,N'-diphenyl-N,N-bis(3-methylphenyl)-1,1-biphenyl-4,4'-diamine and a polymer blended binder consisting of a film forming bisphenol A polycarbonate of poly(4,4'-isopropylidene diphenyl carbonate) and an organic acid terminated A-B diblock copolymer.

In these embodiments, the bisphenol A polycarbonate (PCA) used for the formation of polymer blended binder has a weight average molecular weight (Mw) of from about 50,000 to about 200,000 and is given in the molecular formula below:

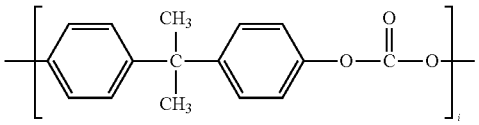

wherein i, the degree of polymerization, is a positive integer of between 20 and about 80. Whereas the organic acid containing A-B diblock copolymer in the polymer blended binder is a high molecular weight film forming linear copolymer having a general Molecular Formula (I) shown below:

$$R_1\text{-}(\text{[Block A]}_z\text{-[Block B]}_y)_n\text{OH} \qquad \text{Formula (I)}$$

wherein block A is a polycarbonate repeating unit, block B is an organic acid containing repeating unit, z represents the number of carbonate repeating units of block A and is, for example, from about 9 to about 18, from about 27 to about 36, or from about 45 to about 54, y represents the number of organic acid containing repeating units of block B and is, for example, from about 1 to about 6, or from about 1 to about 2, n represents the degree of polymerization of the A-B diblock copolymer, which can be between about 20 and about 80, between about 30 and about 70, or between about 40 and about 60, and $R_1$ is H or $CH_3$. The copolymer typically has a weight average molecular weight of between about 80,000 and about 250,000 or between about 100,000 and about 200,000, or between about 110,000 and about 150,000.

In an extension of the above embodiments, the disclosed charge transport layer in the flexible electrophotographic imaging member is re-formulated to comprise a charge transport compound of N,N'-diphenyl-N,N'-bis(3-methylphenyl)-1,1-biphenyl-4,4'-diamine and a binary polymer blended binder consisting of a film forming bisphenol Z polycarbonate of poly(4,4'-diphenyl-1,1'-cyclohexane carbonate) and the organic acid terminated A-B diblock copolymer of Formula (I). The bisphenol Z polycarbonate (PCZ) has a weight average molecular weight of from about 80,000 to about 250,000 and a molecular formula of:

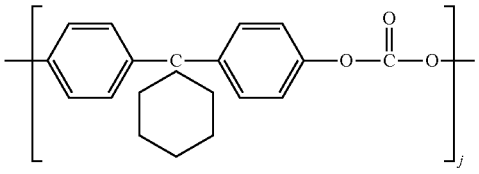

wherein j, the degree of polymerization, is a positive integer of between about 50 and about 200.

In both preceding embodiments, the bisphenol polycarbonate (being PCA or PCZ) and the organic acid containing A-B diblock copolymer present in the binary polymer blended binder of the charge transport layer of all the above imaging members has a weight ratio of the bisphenol polycarbonate to the A-B diblock copolymer of between about 10:90 and about 90:10 or between about 25:75 and about 75:25. Therefore, the resulting imaging member prepared to have the charge transport layer of present disclosure provides photoelectrical tune-ability property as well as amine chemical quenching/neutralization.

In alternative embodiments, the imaging members are prepared to have a lubricated surface; that is the charge transport layer is re-formulated to contain a modified polymer blended binder, formed to give two composition variations according to the description below:

In one modified polymer blended binder composition, the charge transport compound in the charge transport layer is molecularly dispersed or dissolved in a modified binary polymer blended binder which consists of the bisphenol A polycarbonate and the organic acid containing A-B diblock copolymer plus a slippery nano silicon oxide particle dispersion of Polyhedral Oligomeric Silsesquioxane (POSS) in the blended binder matrix.

In the second modified polymer blended binder composition, the modified polymer blended binder is alternatively formed by blending the bisphenol Z polycarbonate and the organic acid containing A-B diblock copolymer plus a slippery nano silicon oxide particle dispersion of Polyhedral Oligomeric Silsesquioxane (POSS) in the blended binder matrix.

In these imaging members, containing POSS dispersion in the modified polymer blended binder embodiments, the bisphenol polycarbonate (being either PCA or PCZ) and the A-B diblock copolymer present in each respective binary polymer blended binder of the charge transport layer has a weight ratio of the bisphenol polycarbonate to the A-B diblock copolymer of between about 10:90 and about 90:10 or between about 25:75 and about 75:25. For the amount of POSS particle dispersion added into the binary polymer blended binder, it is from about 5 to about 40% wt or from about 10 to 30% wt for achieving optimum result, based on the combined weight of the resulting polymer blended binder and POSS particle dispersion.

Both of the photoelectrically tune-able imaging members obtained as described above provide an added benefit of lowering the surface energy of the charge transport layer to provide contact friction reduction, improved wear resistance, and chemical amine contaminate neutralization/quenching capability.

Since the anatomy of a PUSS nanostructured chemical is based according to the general particle representation shown below, it does therefore have a wide variety of molecular structures:

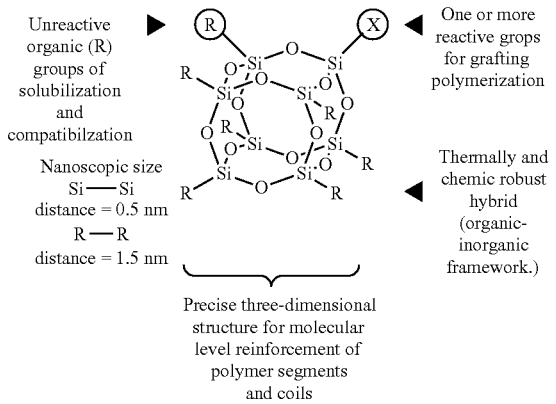

In the low surface energy imaging member embodiments, the charge transport layer is alternatively reformulated to contain a re-designed binary polymer blended binder which has two low surface energy design variations according to the following description.

In the first variation, one low surface energy polymer blended binder is formed from binary blending of a polysiloxane/polycarbonate random copolymer and the A-B diblock copolymer. One example of a typical low surface energy polysiloxane/polycarbonate random copolymer is represented by

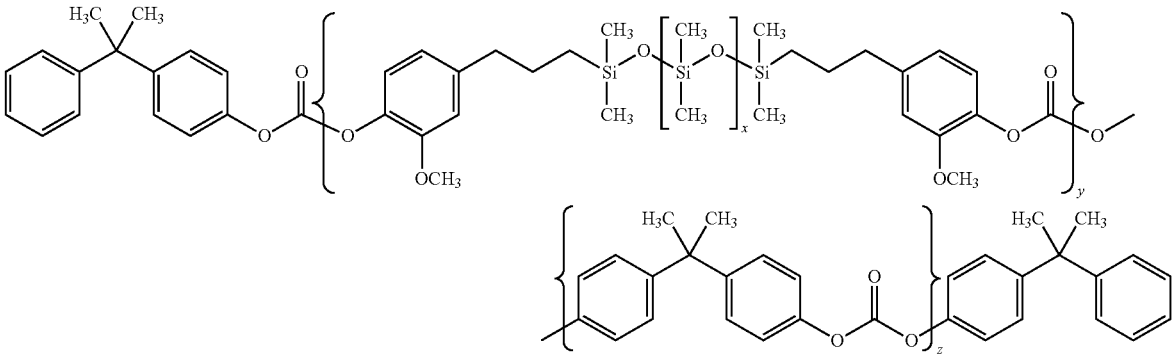

wherein x is an integer between about 40 and about 50 while y and z are integers representing a number of the respective repeating units.

In the second variation, the low surface energy polymer blended binder is formed from binary blending of a polycarbonate grafted polysiloxane copolymer and the A-B diblock copolymer. One example representation of a typical polycarbonate grafted polysiloxane copolymer is shown below:

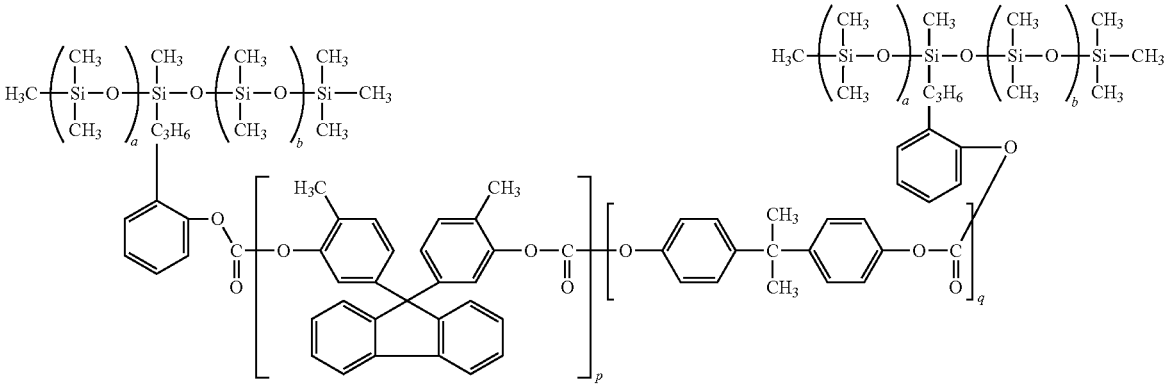

wherein a, b, p and q are integers representing a number of repeating units;

In all these embodiments having low surface energy imaging member, the disclosed polymer blended binder in the charge transport layer in the flexible electrophotographic imaging member is formulated to give a low surface energy binary polymer blended binder. The binary polymer blended binder has a weight ratio of random (or graft) low surface energy copolymer to the A-B diblock copolymer of between about 10:90 and about 50:50 or between about 20:80 and about 30:70. Therefore, the resulting charge transport layer not only provides photoelectrical tune-ability property and amine chemical quenching/neutralization protection, but it also provides surface contact friction reduction to facilitate surface cleaning and low surface energy to enhance toner image release to the receiving paper for copy quality enhancement.

For purposes of this disclosure, the term "polymer blended binder" is defined as meaning that the binder of the present embodiments is formed from mixing compatible polymers to give a homogeneously miscible polymer blended alloy without phase separation. An "A-B diblock copolymer" is one in which identical mer units are clustered in blocks along the copolymer chain backbone. A "random copolymer" is one having two different units that are randomly dispersed along the chain. A "graft copolymer" is one having homopolymer side branches of one type grafted to a homopolymer main chains that are composed of a different mer. Such definitions can be found in MATERIALS SCIENCE AND ENGINEERING: An Introduction, Third Edition, William D. Callister, Jr., John Wiley & Sons, Inc, pp. 460-461 (1994).

A typical conventional negatively charged flexible electrophotographic imaging member is illustrated in FIG. 1. The substrate 10 has an optional conductive layer 12. An optional hole blocking layer 14 disposed onto the conductive layer 12 is coated over with an optional adhesive layer 16. The charge generating layer 18 is located between the adhesive layer 16 and the charge transport layer 20. An optional ground strip layer 19 operatively connects the charge generating layer 18 and the charge transport layer 20 to the conductive ground plane 12, and an optional overcoat layer 32 is applied over the charge transport layer 20. An anti-curl backing layer 1 is applied to the side of the substrate 10 opposite from the electrically active layers to render imaging member flatness.

The layers of the imaging member include, for example, an optional ground strip layer 19 that is applied to one edge of the imaging member to promote electrical continuity with the conductive ground plane 12 through the hole blocking layer 14. The conductive ground plane 12, which is typically a thin metallic layer, for example a 10 nanometer thick titanium coating, may be deposited over the substrate 10 by vacuum deposition or sputtering process. The other layers 14, 16, 18, 20 and 43 are to be separately and sequentially deposited, onto to the surface of conductive ground plane 12 of substrate 10 respectively, as wet coating layer of solutions comprising a solvent, with each layer being dried before deposition of the next subsequent one. An anticurl back coating layer 1 may then be formed on the backside of the support substrate 1. The anticurl back coating 1 is also solution coated, but is applied to the back side (the side opposite to all the other layers) of substrate 1, to render imaging member flatness.

The Substrate

The imaging member support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The support substrate 10 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate (PEN) available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate may have a number of many different configurations, such as, for example, a plate, a drum, a scroll, an endless flexible belt and the like. In one embodiment, the substrate is in the form of a seamed flexible belt.

The thickness of the support substrate 10 depends on numerous factors, including flexibility, mechanical performance, and economic considerations. The thickness of the support substrate may range from about 50 micrometers to about 3,000 micrometers. In embodiments of flexible imaging member belt preparation, the thickness of substrate used is from about 50 micrometers to about 200 micrometers for achieving optimum flexibility and to effect tolerable induced imaging member belt surface bending stress/strain when a belt is cycled around small diameter rollers in a machine belt support module, for example, the 19 millimeter diameter rollers.

An exemplary functioning support substrate 10 is not soluble in any of the solvents used in each coating layer solution, has good optical transparency, and is thermally stable up to a high temperature of at least 150° C. A typical support substrate 10 used for imaging member fabrication has a thermal contraction coefficient ranging from about $1\times10^{-5}$/° C. to about $3\times10^{-5}$/° C. and a Young's Modulus of between about $5\times10^{-5}$ psi ($3.5\times10^{-4}$ Kg/cm2) and about $7\times10^{-5}$ psi ($4.9\times10^{-4}$ Kg/cm2).

The Conductive Ground Plane

The conductive ground plane layer 12 may vary in thickness depending on the optical transparency and flexibility desired for the electrophotographic imaging member. For a typical flexible imaging member belt, it is desired that the thickness of the conductive ground plane 12 on the support substrate 10, for example, a titanium and/or zirconium conductive layer produced by a sputtered deposition process, is in the range of from about 2 nanometers to about 75 nanometers to effect adequate light transmission through for proper back erase. In particular embodiments, the range is from about 10 nanometers to about 20 nanometers to provide optimum combination of electrical conductivity, flexibility, and light transmission. For electrophotographic imaging process employing back exposure erase approach, a conductive ground plane light transparency of at least about 15 percent is generally desirable. The conductive ground plane need is not limited to metals. Nonetheless, the conductive ground plane 12 has usually been an electrically conductive metal layer which may be formed, for example, on the substrate by any suitable coating technique, such as a vacuum depositing or sputtering technique. Typical metals suitable for use as conductive ground plane include aluminum, zirconium, niobium, tantalum, vanadium, hafnium, titanium, nickel, stainless steel, chromium, tungsten, molybdenum, combinations thereof, and the like. Other examples of conductive ground plane 12 may be combinations of materials such as conductive indium tin oxide as a transparent layer for light having a wavelength between about 4000 Angstroms and about 9000 Angstroms or a conductive carbon black dispersed in a plastic binder as an opaque conductive layer. However, in the event where the entire substrate is chosen to be an electrically conductive metal, such as in the case that the electrophotographic imaging process designed to use front exposure erase, the outer surface thereof can perform the function of an electrically conductive ground plane so that a separate electrical conductive layer 12 may be omitted.

For the reason of convenience, all the illustrated embodiments herein after will be described in terms of a substrate layer 10 comprising an insulating material including organic polymeric materials, such as, polyethylene terephthalate (MYLAR) or polyethylene naphthalate (PEN) having a conductive ground plane 12 comprising of an electrically conductive material, such as titanium or titanium/zirconium, coating over the support substrate 10.

The Hole Blocking Layer

A hole blocking layer 14 may then be applied to the conductive ground plane 12 of the support substrate 10. Any suitable positive charge (hole) blocking layer capable of forming an effective barrier to the injection of holes from the adjacent conductive layer 12 into the overlaying photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer 14 may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl) methyl diethoxysilane which has the formula [H2N(CH2)4]CH3Si(OCH3)2, and (gamma-aminopropyl) methyl diethoxysilane, which has the formula [H2N(CH2)3]CH33Si(OCH3)$_2$, and combinations thereof, as disclosed, for example, in U.S. Pat. Nos. 4,338,387; 4,286,033; and 4,291,110, incorporated herein by reference in their entireties. A specific hole blocking layer comprises a reaction product between a hydrolyzed silane or mixture of hydrolyzed silanes and the oxidized surface of a metal ground plane layer. The oxidized surface forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. patents are incorporated herein by reference in their entireties.

The hole blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The adhesive interface layer 16 may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. However, in some alternative electrophotographic imaging member designs, the adhesive interface layer 16 is entirely omitted.

Any suitable solvent or solvent mixtures may be employed to form a coating solution of the polyester for the adhesive interface layer 36. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The photogenerating (e.g., charge generating) layer 18 may thereafter be applied to the adhesive layer 16. Any suitable charge generating binder layer 18 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder used for the charge generating layer 18 is PCZ-400 (poly(4,4'-dihydroxydiphenyl-1-1-cyclohexane) which has a molecular weight of about 40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer 18 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Ground Strip Layer

Other layers such as conventional ground strip layer 19 including, for example, conductive particles dispersed in a film forming binder may be applied to one edge of the imaging member to promote electrical continuity with the conductive ground plane 12 through the hole blocking layer 14. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer 19 may have a thickness from about 7 micrometers to about 42 micrometers, for example, from about 14 micrometers to about 23 micrometers.

The Charge Transport Layer

The charge transport layer 20 is thereafter applied over the charge generating layer 18 and become, as shown in FIG. 1, the exposed outermost layer of the imaging member. It may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The charge transport layer 20 is normally transparent in a wavelength region in which the electrophotographic imaging member is to be used when exposure is effected therethrough to ensure that most of the incident radiation is utilized by the underlying charge generating layer 18. The charge transport layer should exhibit excellent optical transparency with negligible light absorption and neither charge generation nor discharge if any, when exposed to a wavelength of light useful in xerography, e.g., 400 to 900 nanometers. In the case when the imaging member is prepared with the use of a transparent support substrate 10 and also a transparent conductive ground plane 12, image wise exposure or erase may be accomplished through the substrate 10 with all light passing through the back side of the support substrate 10. In this particular case, the materials of the charge transport layer 20 need not have to be able to transmit light in the wavelength region of use for electrophotographic imaging processes if the charge generating layer 18 is sandwiched between the support substrate 10 and the charge transport layer 20. In all events, the exposed outermost charge transport layer 20 in conjunction with the charge generating layer 18 is an insulator to the extent that an electrostatic charge deposited/placed over the charge transport layer is not conducted in the absence of radiant illumination. Importantly, the charge transport layer 20 should trap minimal or no charges as the charge pass through it during the image copying/printing process.

The charge transport layer 20 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes there through. This converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The charge transport component typically comprises small molecules of an organic compound which cooperate to transport charge between molecules and ultimately to the surface of the charge transport layer.

Any suitable inactive resin binder soluble in methylene chloride, chlorobenzene, or other suitable solvent may be employed in the charge transport layer. Exemplary binders include polyesters, polyvinyl butyrals, polycarbonates, polystyrene, polyvinyl formals, and combinations thereof. The polymer binder used for the charge transport layers may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly (4,4'-isopropylidene diphenyl carbonate), poly(4,4'-diphenyl-1,1'-cyclohexane carbonate), and combinations thereof. The molecular weight of the polymer binder used in the charge transport layer can be, for example, from about 20,000 to about 1,500,000.

Exemplary charge transport components include aromatic polyamines, such as aryl diamines and aryl triamines. Exemplary aromatic diamines include N,N'-diphenyl-N,N'-bis(alkylphenyl)-1,1'-biphenyl-4,4-diamines, such as mTBD, which has the formula (N,N'-diphenyl-N,N'-bis[3-methylphenyl]-[1,1'-biphenyl]-4,4'-diamine); N,N'-diphenyl-N,N'-bis(chlorophenyl)-1,1'-biphenyl-4,4'-diamine; and N,N-bis-(4-methylphenyl)-N,N-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein by reference in their entireties.

The concentration of the charge transport component in layer 20 may be, for example, at least about 5 weight % and may comprise up to about 60 weight %. The concentration or composition of the charge transport component may vary through layer 20, as disclosed, for example, in U.S. Pat. No. 7,033,714; U.S. Pat. No. 6,933,089; and U.S. Pat. No. 7,018,756, the disclosures of which are incorporated herein by reference in their entireties.

In one exemplary embodiment, charge transport layer 20 comprises an average of about 10 to about 60 weight percent N,N'-diphenyl-N,N'-bis(3-methylphenyl)-1,1'-biphenyl-4,4'-diamine, or from about 30 to about 50 weight percent N,N'-diphenyl-N,N'-bis(3-methylphenyl)-1,1'-biphenyl-4,4'-diamine.

The charge transport layer 20 is an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 20 to the charge generator layer 18 is maintained from about 2:1 to about 200:1 and in some instances as great as about 400:1.

The charge transport layer 20 is a solid solution including a charge transport component, such as N,N'-diphenyl-N,N'-bis(3-methylphenyl)-1,1'-biphenyl-4,4'-diamine, molecularly dispersed/dissolved in a polycarbonate binder, the polycarbonate binder is typically a bisphenol A polycarbonate of poly(4,4'-isopropylidene diphenyl carbonate). The bisphenol A polycarbonate used for typical charge transport layer formulation is FPC 0170, having a molecular weight of about 120,000 and commercially available from Mitsubishi Chemicals Corp. The molecular structure of bisphenol A polycarbonate, poly(4,4'-isopropylidene diphenyl carbonate), is given in the formula below:

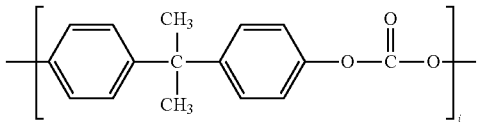

(bisphenol A polycarbonate)

wherein i indicates the degree of polymerization which is a positive integer of between 20 and about 80.

The charge transport layer 20 may have between about 10 and about 50 micrometers in thickness, or between about 20 and about 40 micrometers. Since the typical conventional charge transport layer 20 does have a substantially greater thermal contraction coefficient constant (3.7 times) compared to that of the support substrate 10, the prepared flexible electrophotographic imaging member (using a 3-mil flexible biaxially oriented PET substrate and say, for example, a 29 micrometers charge transport layer) will exhibit spontaneous upward curling, into a 1½ inch roll if unrestrained, due to the result of larger dimensional contraction in the charge transport layer 20 than the support substrate 10, as the imaging member cools from the glass transition temperature of the charge transport layer down to room ambient temperature of 25° C. after the heating/drying processes of the applied wet charge transport layer coating. The consequence of greater dimensional contraction of the charge transport layer 20 than that of the substrate support 10 after cooling causes internal tension build-up in the layer to pull the imaging member inwardly and result in imaging member curling.

An anti-curl back coating 1 of about 17 micrometers is therefore needed and applied to the back side of the support substrate 10 (which is the side opposite the side bearing the electrically active coating layers) to counteract against the effect of the 29-micrometer thick charge transport layer in order to fully control the curl and render the prepared imaging member with desired flatness.

The Anticurl Back Coating

Since the charge transport layer 20 is applied by solution coating process, the applied wet film is dried at elevated temperature and then subsequently cooled down to room ambient. The resulting imaging member web (comprising a 29 micrometers charge transport layer and a 3 mils PET substrate) if, at this point, not restrained, will spontaneously curl upwardly into a 1½ inch tube due to greater dimensional contraction and shrinkage of the Charge transport layer than that of the substrate support layer 10. An anti-curl back coating 1, as the conventional imaging member shown in FIG. 1, is then applied to the back side of the support substrate 10 (which is the side opposite the side bearing the electrically active coating layers) in order to render the prepared imaging member with desired flatness.

Generally, the anticurl back coating 1 comprises a thermoplastic polymer and an adhesion promoter. The thermoplastic polymer, in some embodiments being the same as the polymer binder used in the charge transport layer, is typically a bisphenol A polycarbonate, which along with the addition of an adhesion promoter of polyester are both dissolved in a solvent to form an anticurl back coating solution. The coated anticurl back coating 1 must adhere well to the support substrate 10 to prevent premature layer delamination during imaging member belt machine function in the field.

In a conventional anticurl back coating, an adhesion promoter of copolyester is included in the bisphenol A polycarbonate poly(4,4'-isopropylidene diphenyl carbonate) material matrix to provide adhesion bonding enhancement to the substrate support. Satisfactory adhesion promoter content is from about 0.2 percent to about 20 percent or from about 2 percent to about 10 percent by weight, based on the total weight of the anticurl back coating The adhesion promoter may be any known in the art, such as for example, VITEL PE2200 which is available from Bostik, Inc. (Middleton, Mass.). To counteract the pulling effect of a 29 micrometers charge transport layer, the anticurl back coating of 17 micrometers in thickness is needed to control imaging member upward curling and provide flatness. A typical, conventional anticurl back coating formulation has a 92:8 weight ratio of polycarbonate to adhesive.

Imaging Member Having Photoelectrical Tune-Ability

Figure 2:
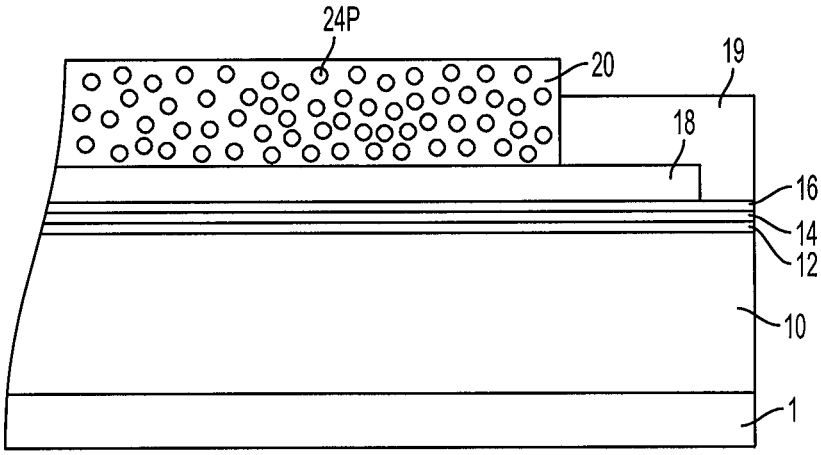
FIG. 2 is a cross-sectional view of a flexible multilayered electrophotographic imaging member having a single charge transport layer prepared according to the present embodiments.

FIG. 2 discloses a full flexible imaging member structure prepared according to the present embodiments to give an amine species resistance charge transport layer. In the embodiments, the substrate 10, conductive ground plane 12, hole blocking layer 14, adhesive interface layer 16, charge generating layer 18, ground strip layer 16, charge transport layer 20, and anticurl back coating 1 of the disclosed imaging member are prepared to include the same materials, compositions, thicknesses, and follow the same procedures as those described in the conventional imaging member of FIG. 1, but with the exception that the bisphenol A polycarbonate binder in charge transport layer 20 is re-designed to use a polymer blended binder 24P according to the present embodiments. The polymer blended binder 24P in the charge transport layer 20 comprises a blending of the bisphenol A polycarbonate and a film forming organic acid terminated A-B diblock copolymer.

According to aspects illustrated herein, there is provided a flexible imaging member comprising a flexible substrate 10, a conductive ground plane 12, a hole blocking layer, 14, an adhesive interface layer 16, a charge generating layer 18 disposed on the adhesive interface layer 16, a ground strip layer 16, and a charge transport layer 20 of present disclosure disposed on the charge generating layer 18, and an anticurl back coating 1 to maintain imaging member flatness. The charge transport layer 20 of this disclosure is a binary solid solution formulated to comprise a charge transport compound of N,N-diphenyl-N,N-bis(3-methylphenyl)-1,1-biphenyl-4,4'-diamine molecularly dispersed/dissolved in a polymer blended binder 24P. The polymer blended binder 24P is prepared by mixing the bisphenol A polycarbonate poly(4,4'-isopropylidene diphenyl carbonate) and a specifically selected organic acid terminated copolymer to effect amine species quenching/neutralization (by acid-base reaction) protection and provide the resulting imaging member photoelectrical tune-ability function as well.

In one embodiment example of the flexible imaging member of this disclosure, the organic acid terminated A-B diblock copolymer used to blend with a polycarbonate and form the blended binder 24P in the charge transport layer 20 is a linear saturated polymer having a general Molecular Formula (I) representation shown in the following:

$$R_1\text{-}(\text{[Block A]}_z\text{-[Block B]}_y)_n\text{OH} \qquad \text{Formula (I)}$$

wherein block A is a polycarbonate repeating unit, block B is an organic acid containing repeating unit, z represents the number of carbonate repeating units of block A and is, for example, from about 9 to about 18, from about 27 to about 36, or from about 45 to about 54, y represents the number of organic acid containing repeating units of block B and is, for example, from about 1 to about 6, or from about 1 to about 2, n represents the degree of polymerization of the A-B diblock copolymer, which can be between about 20 and about 80, between about 30 and about 70, or between about 40 and about 60, $R_1$ is H or $CH_3$. The copolymer typically has a weight average molecular weight of between about 80,000 and about 250,000 or between about 100,000 and about 200,000, or between about 110,000 and about 150,000.

The film forming A-B diblock copolymer of Formula (I) used for forming the polymer blended binder 24P formulations is a polycarbonate derived from different types of polycarbonates and by the inclusion of a small fraction from one of different dicarboxylic acids into the polymer backbone, resulting in a copolymer that contains from about 98 mole percent to about 80 mole percent, or from about 95 mole percent to about 85 mole percent of a carbonate segmental block A linearly linking to from about 2 mole percent to about 20 mole percent or from about 5 mole percent to about 15 mole percent of a segmental block B containing of a dicarboxylic acid terminal in the A-B diblock copolymer chain. In specific embodiments, the resulting copolymer contains about 90 mole percent of a segment block A linearly linking to about 10 mole percent of a segmental block B of an acid terminal in the A-B diblock copolymer chain.

The polycarbonate segment block A in the A-B diblock copolymer of Formula (I) has the following general Structure (A):

Structure (A)

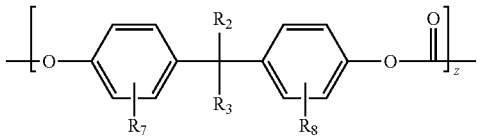

wherein each $R_2$, $R_3$ is independently H or lower $C_1$-$C_3$ alkyl, or $R_2$ and $R_3$ taken together with the C atom to which they are attached form an alkylcyclic ring, where any ring atom of the alkylcyclic ring may be optionally substituted with an alkyl; each $R_7$, $R_8$ is independently H or lower $C_1$-$C_3$ alkyl; and z is between about 9 and about 18, between about 27 and about 36, or between about 45 and about 54. In certain embodiments, each of $R_2$, $R_3$ is methyl, or $R_2$ and $R_3$ taken together with the C atom to which they are attached form a cyclohexane, where any ring atom of the cyclohexane may be optionally substituted with one or more methyl. In certain embodiments, each of $R_7$, $R_8$ is H or each of $R_7$, $R_8$ is methyl.

While the organic acid segment block B in the A-B diblock copolymer of Formula (I) has the following general Structure (B):

Structure (B)

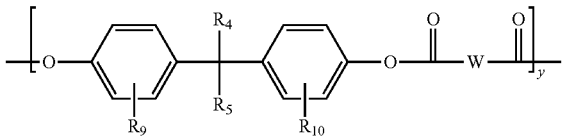

wherein each $R_4$, $R_5$ is independently H or lower $C_1$-$C_3$ alkyl, or $R_4$ and $R_5$ taken together with the C atom to which they are attached form an alkylcyclic ring, where any ring atom of the alkylcyclic ring may be optionally substituted with an alkyl; each $R_9$, $R_{10}$ is independently H or a lower $C_1$-$C_3$ alkyl; and y is between about 1 and about 2. In certain embodiments, each of $R_4$, $R_5$ is methyl, or $R_4$ and $R_5$ taken together with the C atom to which they are attached form a cyclohexane, where any ring atom of the cyclohexane may be optionally substituted with one or more methyl. In certain embodiments, each of $R_9$, $R_{10}$ is H or each of $R_9$, $R_{10}$ is methyl.

In specific embodiments, the film forming A-B diblock copolymer of Formula (I) used for polymer blended binder 24P is a polycarbonate derived from the bisphenol A polycarbonate by the inclusion of a small fraction of dicarboxylic acid to form a linear copolymer chain backbone; the resulting copolymer contains about 90 mole percent of a bisphenol A segment block A linearly linking to about 10 mole percent of a segmental block B of dicarboxylic acid terminal in the A-B diblock copolymer chain.

Exemplary polycarbonates (Block A) of the Structure (A) in the A-B diblock copolymer is a selection from one of the following carbonates:

wherein z is an integer representing the numbers of repeating segmental carbonate unit, and is from about 9 to about 18, from about 27 to about 36, or from about 45 to about 54.

The exemplary example of organic acid terminal unit (Block B) of the Structure (B) in the A-B diblock copolymer has any of the following structures:

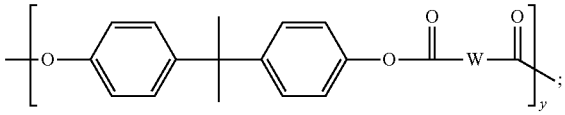

Structure A-1

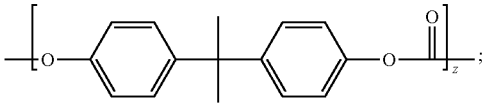

(bisphenol A polycarbonate)

Structure A-2

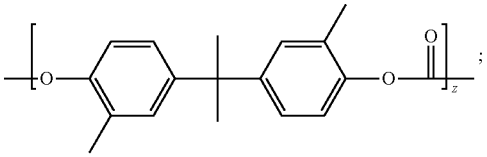

Structure A-3

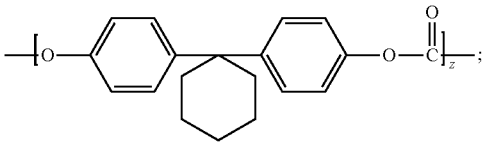

Structure A-4

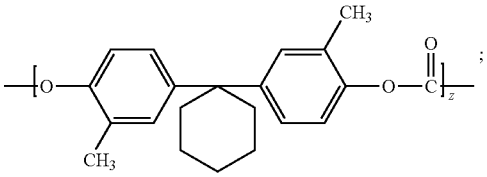

Structure A-5

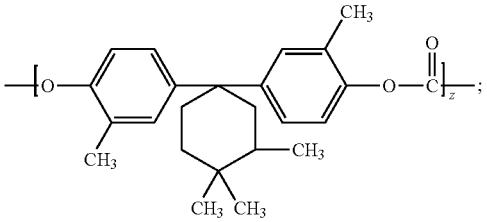

Structure A-6

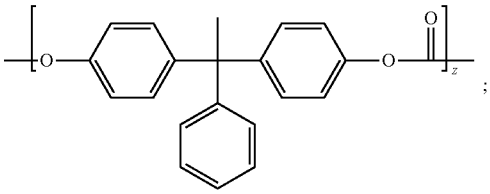

Structure A-7

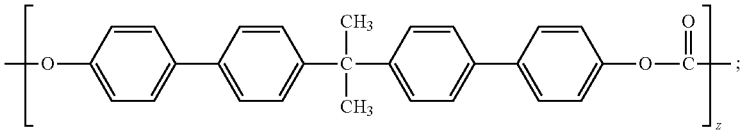

Structure A-8

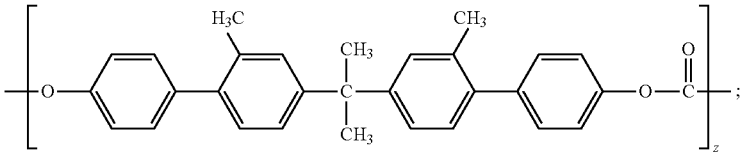

or

Structure A-9

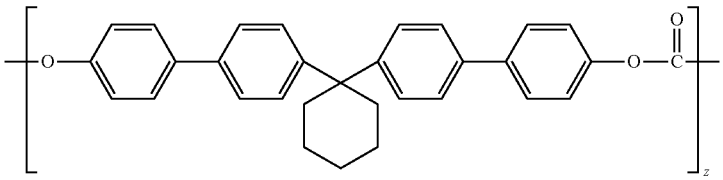

-continued

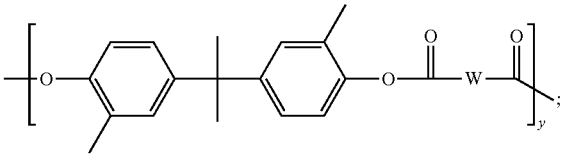

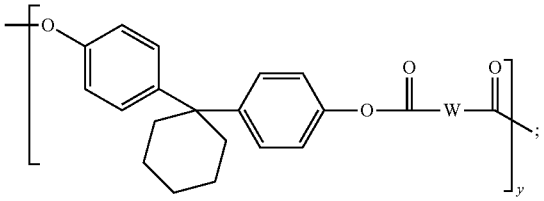

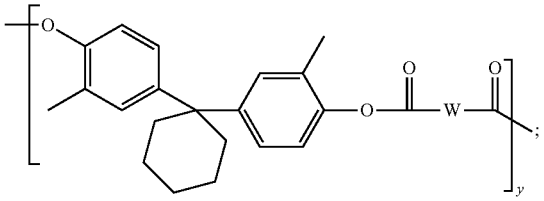

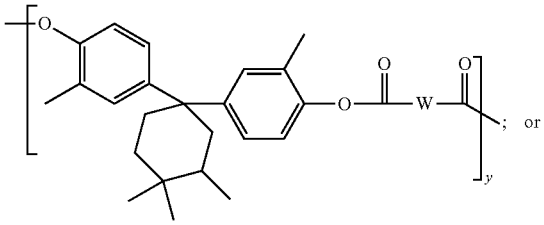

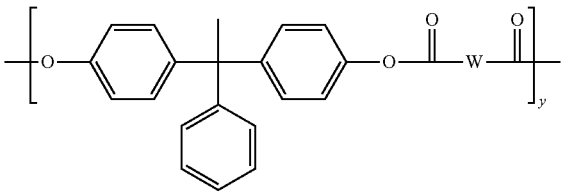

wherein W is an aromatic moiety or an aliphatic moiety, and y is from about 1 to about 6. In certain embodiments, W is an aryl having from 6 to 36 carbon atoms, or from 6 to 24. In certain of such embodiments, W is a phenyl. In certain embodiments, W is an alkylene having from 2 carbon atoms to 10 carbon atoms, from about 3 to about 8 carbons, or from 4 to 6 carbons.

Alternatively, the dicarboxylic acid terminal units (Block B) of Structure (B) in the SA-B diblock copolymer may also include the following structures:

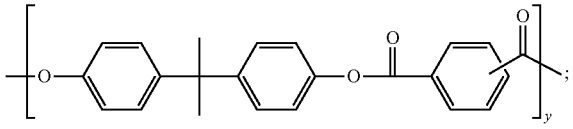

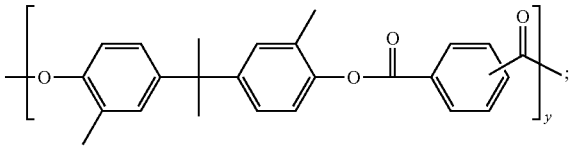

-continued

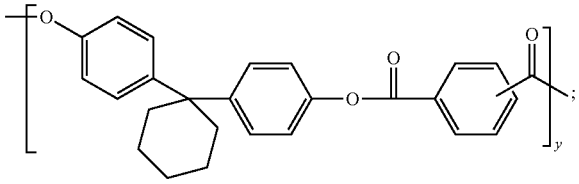

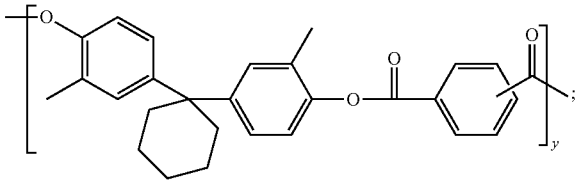

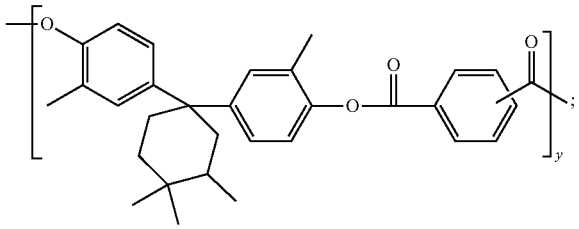

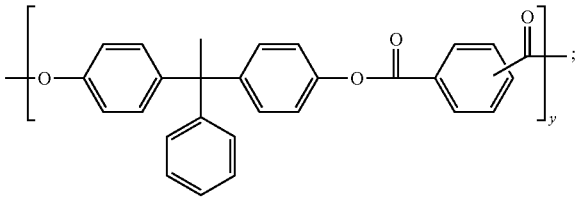

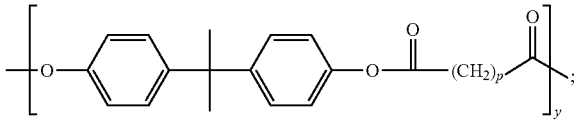

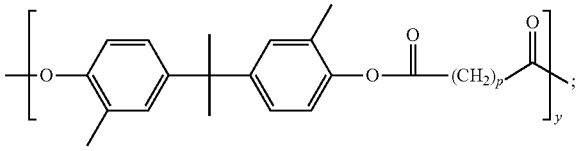

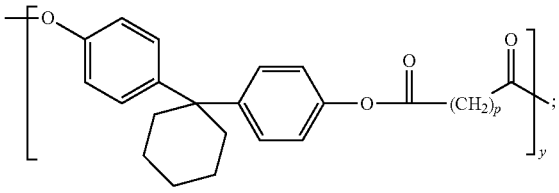

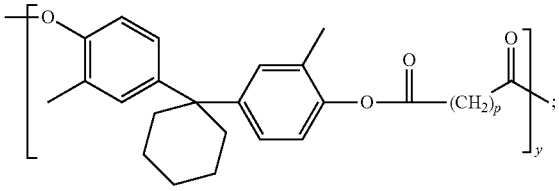

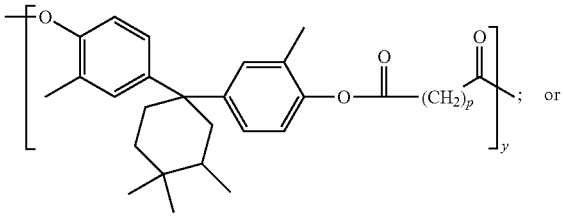

-continued
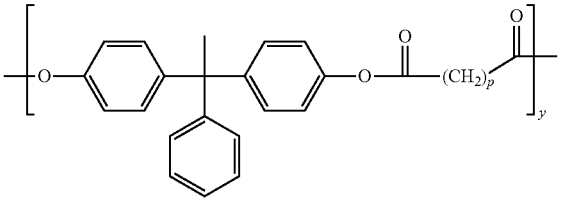
wherein p is from 3 to 8 or from 4 to 6; and y is from about 1 to about 6.
In yet certain of such embodiments, the dicarboxylic acid terminal units have the following structures:
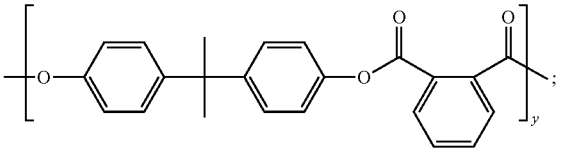
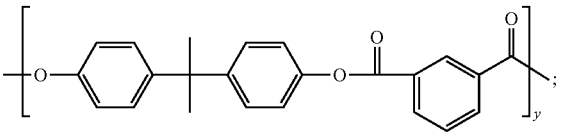
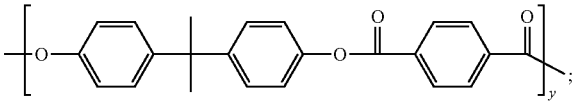
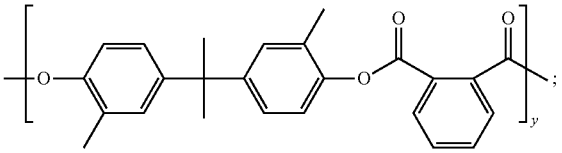
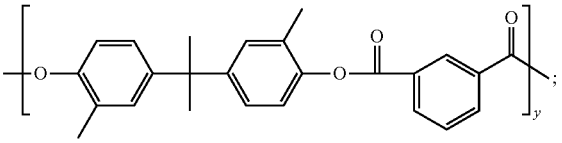
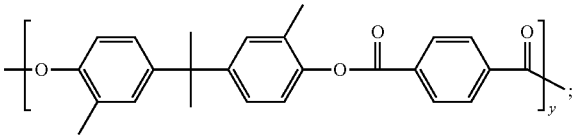
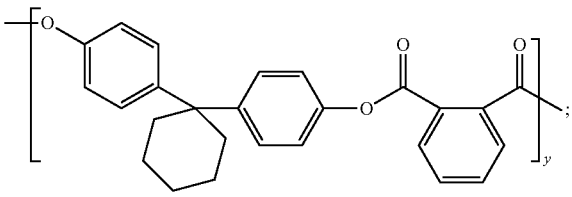
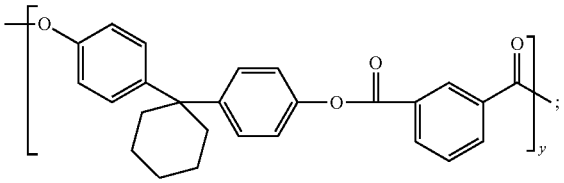
-continued
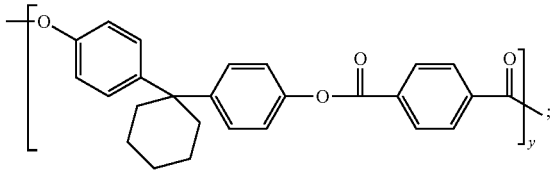
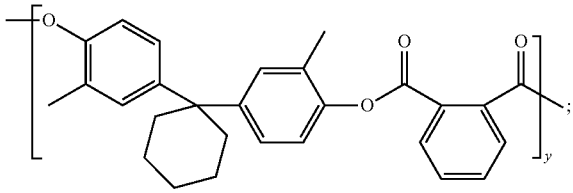
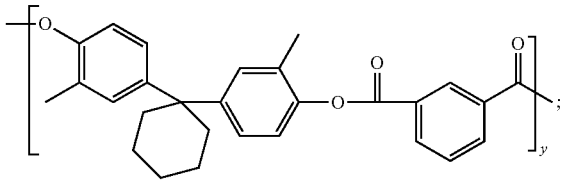
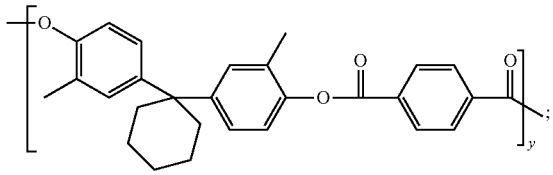
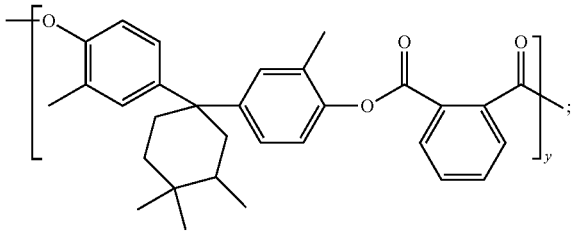
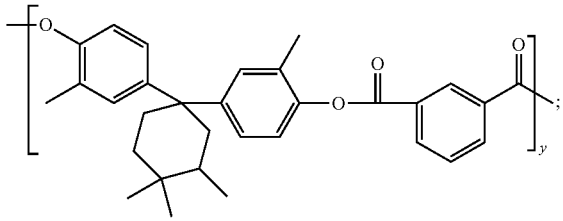
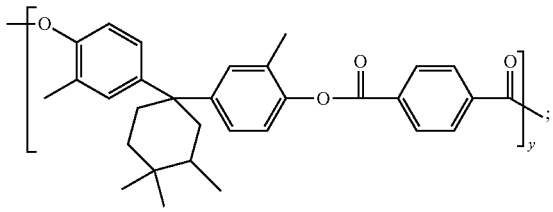
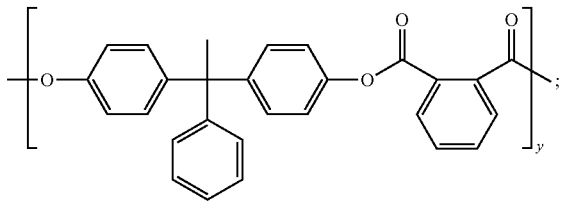

-continued
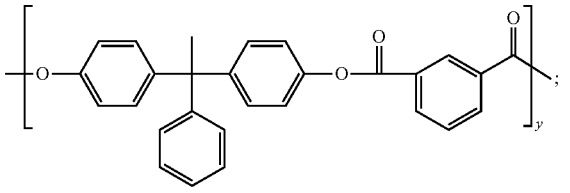
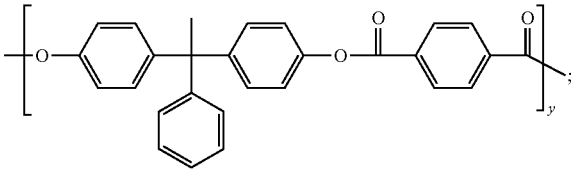
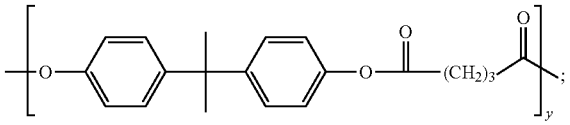
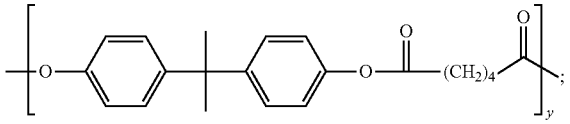
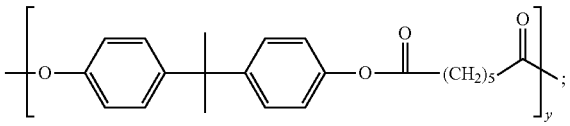
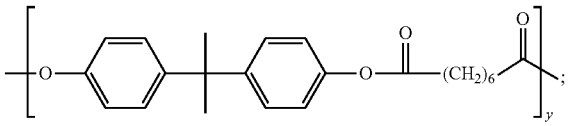
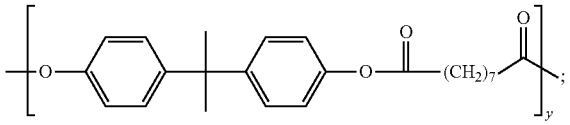
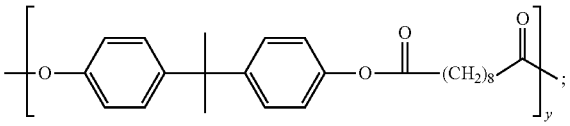
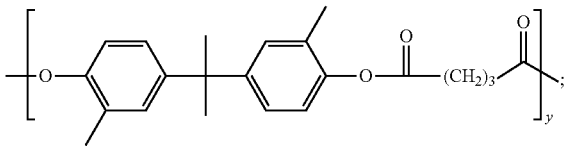
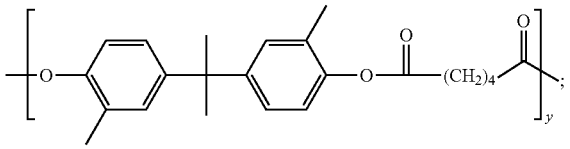
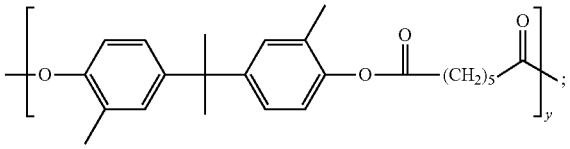
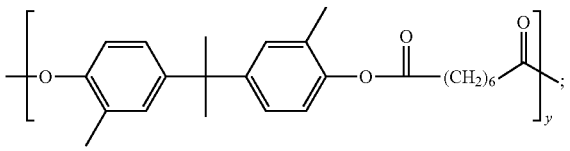
-continued
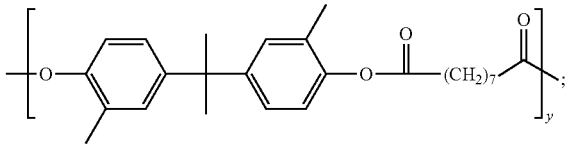
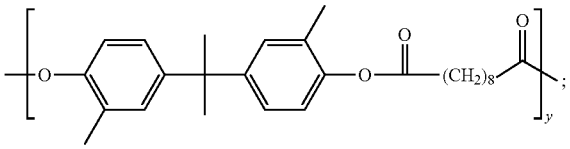
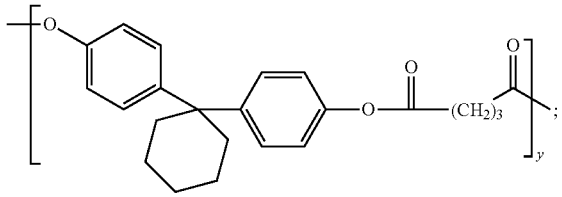
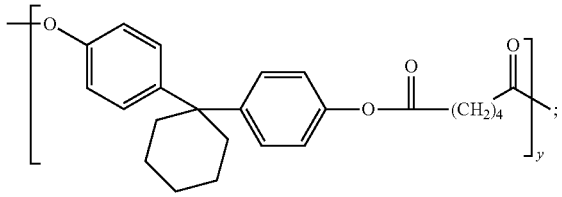
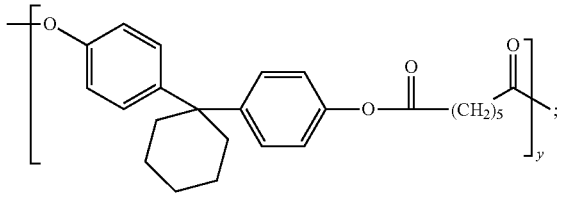
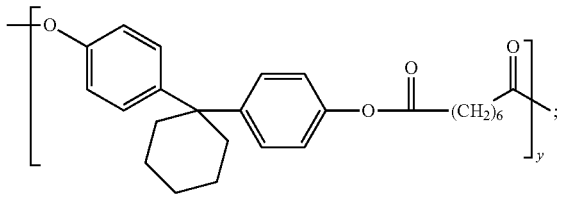
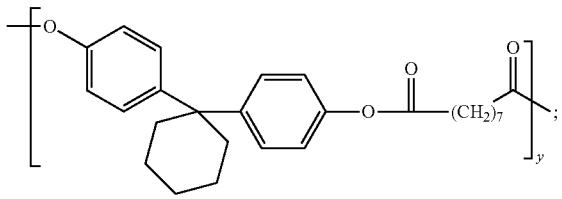
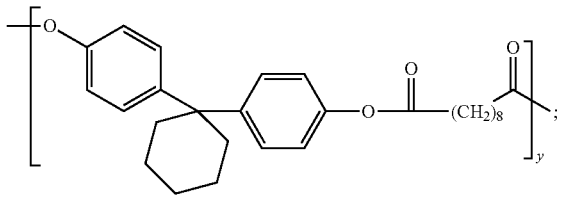
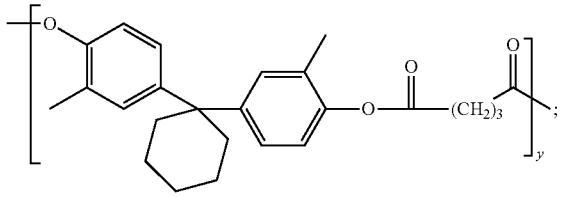

-continued
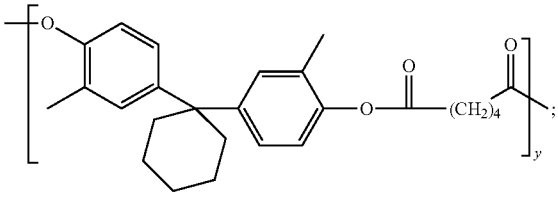
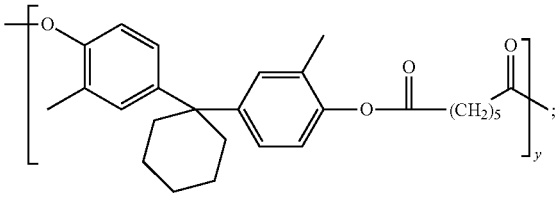
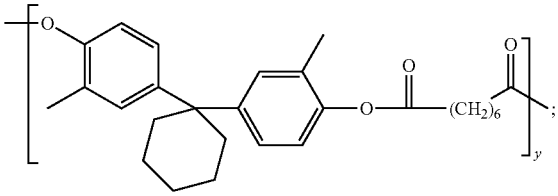
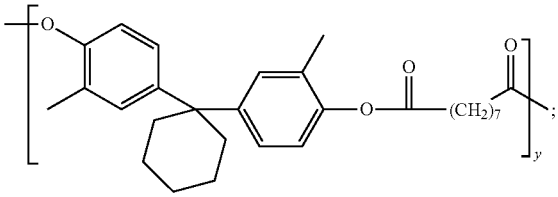
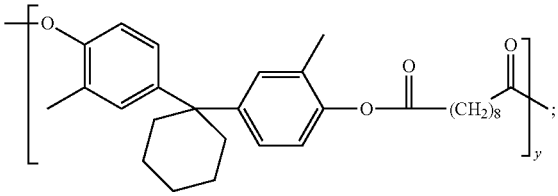
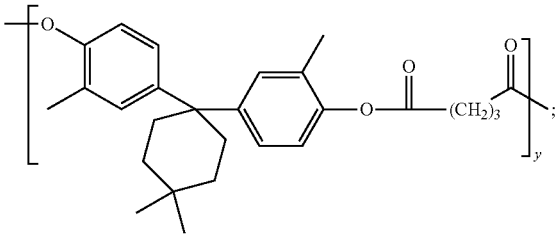
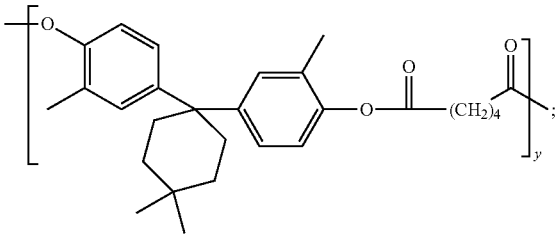
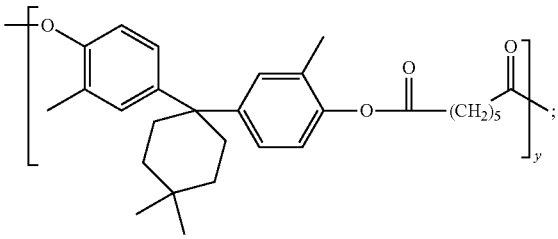
-continued
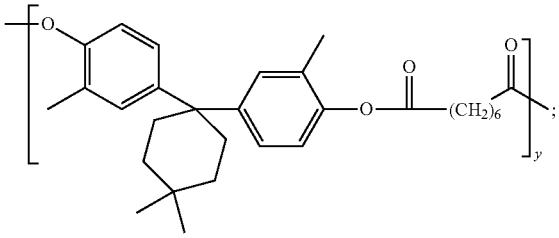
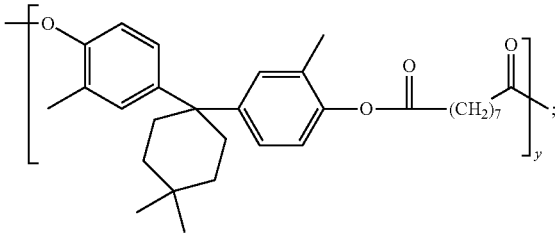
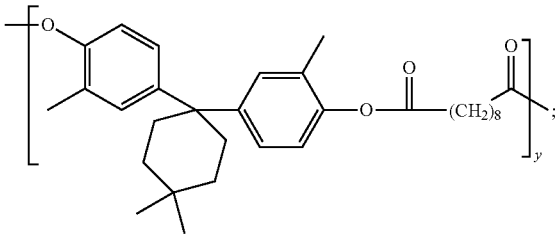
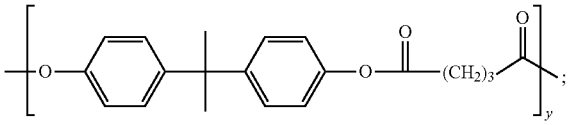
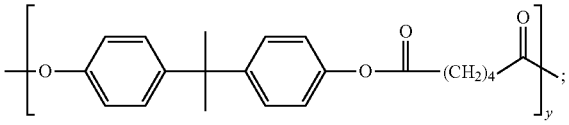
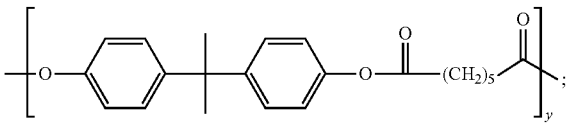
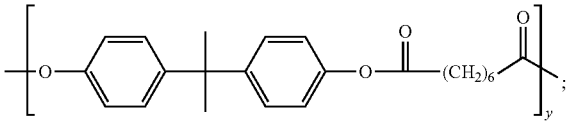
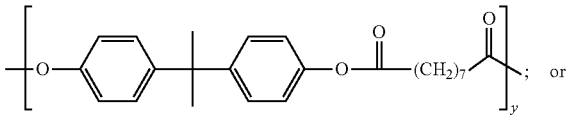
or
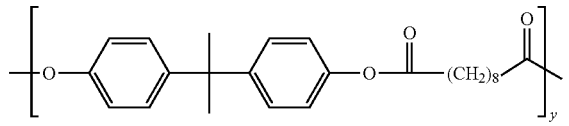
wherein v is 1 to 6.
In specific embodiments, the dicarboxylic acid segment in Block B may be derived from an aromatic dicarboxylic acid such as a phthalic acid, an terephthalic acid, an isophthalic acid, or derived from an aliphatic acid such as an glutaric acid, adipic acid, heptanedioic acid, octanedioic acid, azelaic acid, decanedioic acid, and the like as shown below:

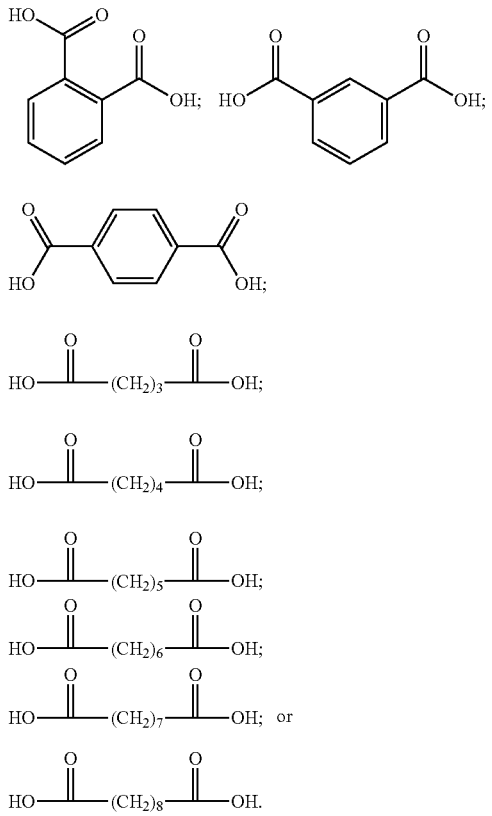

In certain embodiments, the A-B diblock copolymer has a structure of Formula II:

Formula II

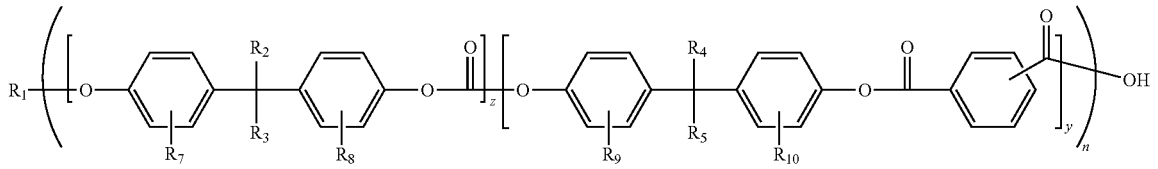

wherein the Block A and Block B are independently selected from the above lists.

In certain embodiments, the A-B diblock copolymer has a structure of Formula III:

Formula III

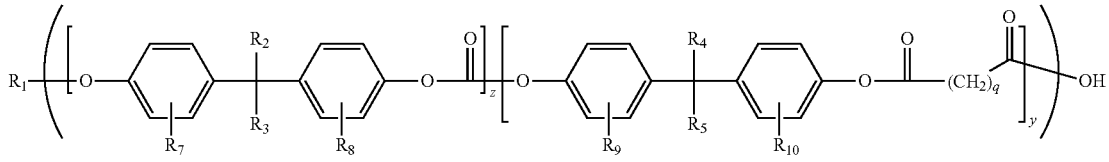

wherein the Block A and Block B are independently selected from the above lists. $R_1$ to $R_5$ and $R_7$ to $R_{10}$ are defined in the present embodiments discussed above.

In a very specific embodiment, flexible imaging member of this disclosure comprises a flexible substrate 10, a conductive ground plane 12, a hole blocking layer, 14, an adhesive interface layer 16, a charge generating layer 18 disposed on the adhesive interface layer 16, a ground strip layer 16, and a charge transport layer 20 of present disclosure disposed on the charge generating layer 18, and an anticurl back coating 1 to maintain imaging member flatness. The charge transport layer 20 is formulated to comprise a charge transport compound of N,N'-diphenyl-N,N-bis(3-methylphenyl)-1,1-biphenyl-4,4'-diamine molecularly dispersed/dissolved in a polymer blended binder 24P. The polymer blended binder 24P used in the charge transport layer 20 is a polymer blend consisting of bisphenol A polycarbonate (PCA) and a specific A-B diblock copolymer. The bisphenol A polycarbonate is poly(4,4'-isopropylidene diphenyl) carbonate as shown in the polymer structure below:

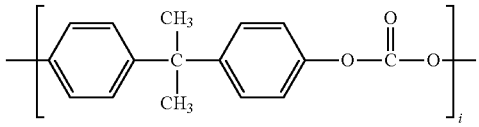

(bisphenol A polycarbonate)

wherein i, the degree of polymerization, is a positive integer of between 20 and about 80. While the A-B diblock copolymer is comprising of a bisphenol A polycarbonate segmental block (A) linearly linking to a phthalic acid containing segmental block (B) terminal; the A-B diblock copolymer is a film forming copolymer as represented by the molecular structures described in Formula (IA) and Formula (IB) below:

Formula (IA)

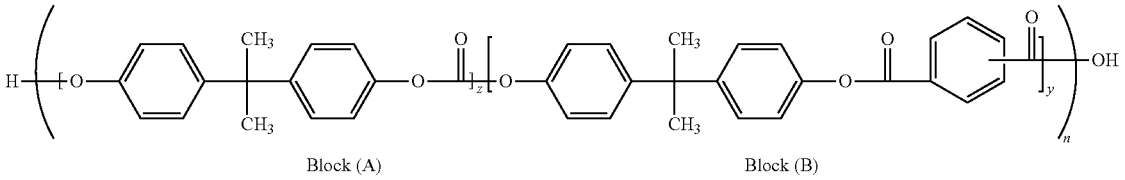

Formula (IB)

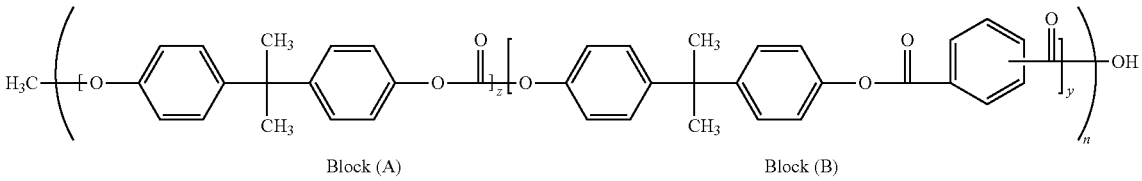

wherein z represents the number of bisphenol A repeating units in segmental block (A) of from about 9 to about 18, y is number of repeating phthalic acid segmental block (B) of from about 1 to about 2, and n is the degree of polymerization between about 20 and about 90 for the copolymer having a weight average molecular weight between about 100,000 and about 250,000 and mixtures thereof. The disclosed charge transport layer has a thickness of from about 20 to about 40 micrometers.

In yet another specific embodiment, the flexible imaging member of this disclosure is again prepared to have the same material compositions, layer(s) thicknesses, and using the same preparation procedures as those described in the above embodiment, but with the exception that the polymer blended binder 24P used in the charge transport layer 20 is modified to consist of blending of a bisphenol Z polycarbonate (PCZ) and the specific organic acid terminated A-B diblock copolymer of Formulas (IA) and (IB). The bisphenol Z polycarbonate is poly(4,4'-diphenyl-1,1'-cyclohexane) carbonate, as given in formula below:

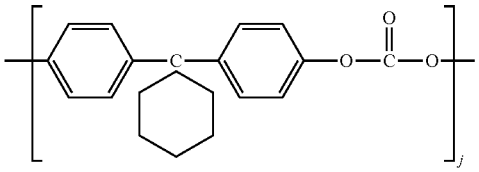

(bisphenol Z polycarbonate)

wherein j, the degree of polymerization, is a positive integer of between about 50 and about 200.

Figure 3:
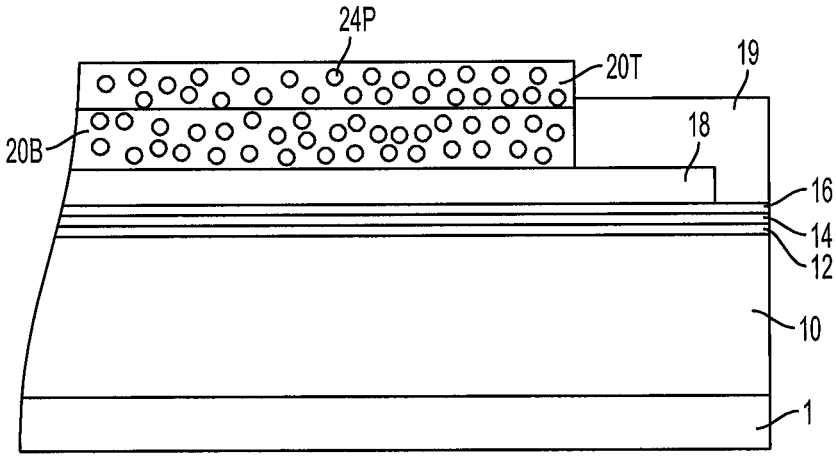
FIG. 3 is a cross-sectional view of a flexible multilayered electrophotographic imaging member having dual charge transport layers prepared according to the present embodiments.

In the further extended embodiments, the flexible imaging member is prepared to comprise a substrate 10, conductive ground plane 12, hole blocking layer 14, adhesive interface layer 16, charge generating layer 18, ground strip layer 16, charge transport layer 20 having the disclosed polymer blended binder formulation, and anticurl back coating 1 by following the same procedures and material compositions as those described in FIG. 2. However, the charge transport layer 20 is re-designed to comprise dual layers: a bottom layer 20B and a top exposed layer 20T according to the illustration in FIG. 3. Both of these layers comprise about the same thickness and utilizing the same disclosed polymer blended binder 24 and same charge transport compound of N,N'-diphenyl-N,N-bis(3-methylphenyl)-1,1-biphenyl-4,4'-diamine, but with the bottom layer containing a greater amount of the charge transport compound than the top exposed layer. The charge transport compound present in the bottom layer 20B is between about 60 and about 80 weight percent while that in the top exposed layer 20T is between about 40 and about 20 weight percent based on the total weight of each respective layer to provide optimum photo-electrical and mechanical functions. In embodiments, both disclosed dual charge transport layers are of the same thickness and have a total thickness of between about 20 and about 40 micrometers.

Figure 4:
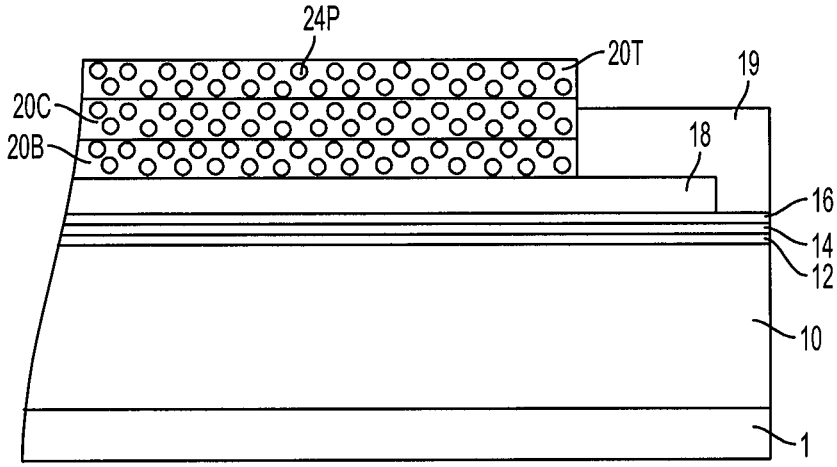
FIG. 4 is a cross-sectional view of a flexible multilayered electrophotographic imaging member having triple charge transport layers prepared according to present embodiments.

In yet further extended embodiments of flexible imaging member of the present disclosure, the charge transport layer is further re-designed to have triple charge transport layers comprising a bottom layer 20B, center layer 20C, and top exposed layer 20T as shown in FIG. 4. All of the triple layers comprise about the same thickness and utilize the same disclosed polymer blended binder 24 as well as same charge transport compound of N,N-diphenyl-N,N'-bis(3-methylphenyl)-1,1-biphenyl-4,4'-diamine, but with the bottom layer 20B containing the greatest and the top exposed layer 20T the least amount of the charge transport compound. The charge transport compound presence in the bottom layer 20B is from about 70 to about 90 weight percent, that in the center layer 20C is from about 40 to about 60 weight percent, and that in the top exposed layer 20T is from about 20 to about 30 weight percent based on the total weight of each respective layer. In embodiments, the disclosed triple charge transport layers are of the same thickness and have a total thickness of from about 20 to about 40 micrometers.

Figure 5:
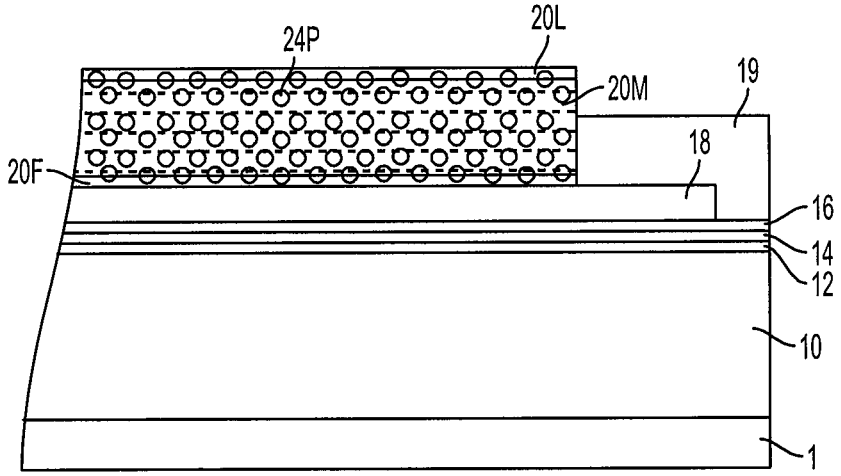
FIG. 5 is a cross-sectional view of a flexible multilayered electrophotographic imaging member having multiple charge transport layers prepared according to another embodiment.

In still yet further extended embodiments of flexible imaging member of this disclosure, the charge transport layer is further re-formulated to give multiple charge transport layers consisting of a first/bottom layer 20F, middle plurality of layers 20M, and last/top exposed layer 20L as shown in FIG. 5. All of these charge transport layers comprise about the same thickness and utilizing the same disclosed polymer blended binder 24P and same charge transport compound of N,N'-diphenyl-N,N'-bis(3-methylphenyl)-1,1-biphenyl-4,4'-diamine, except that the amount of charge transport compound in each layer is decreasing in continuum starting from the first/bottom layer 20F reaches toward the last/top outermost exposed layer 20L of the imaging member, so that the lowest amount is present in the last outermost exposed layer. That means the content of the disclosed polymer blended binder 24P in each charge transport layer is increased, starting from the lowest in first/bottom layer 20F and rising continuously toward the top such that the last/top outermost layer 20L has the highest content of polymer blended/doped binder 24P. From optimum photo-electrical and mechanical function considerations, the charge transport compound presence in the first/bottom layer 20F is from about 70 to about 90 weight percent while that in the last/top exposed layer 20L is from about 20 to about 30 weight percent based on the total weight of each respective layer.

In the embodiments, the imaging member configuration shown in FIG. 5 may have a total of from about 4 to about 10 discreet charge transport layers, or from about 4 to about 6. While the thickness of each of the charge transport layers 20F, 20M, and 40L may be different, but they are preferably to be the same and range from about 0.5 to about 7 micrometers. Generally, the disclosed multiple charge transport layers have a total thickness of between about 20 and about 40 micrometers.

As an alternative to the two discretely separated layers of a charge transport 20 and charge generation layers 18 as those described in FIG. 1, is a simplified imaging member (shown in FIG. 6), having all other layers being formed in the same manners as described in preceding figures, but containing a single imaging layer 22 which has both charge generating and charge transporting capabilities and with the use of the disclosed polymer blended binder 24P according to the illustration. In a conventional electrophotographic imaging member design disclosed in the prior art, for example U.S. Pat. No. 6,756,169, it was prepared to have a single imaging layer 22 that is comprised of a single electrophotographically active layer capable of retaining an electrostatic charge in the dark during electrostatic charging, imagewise exposure and image development.

Figure 6:
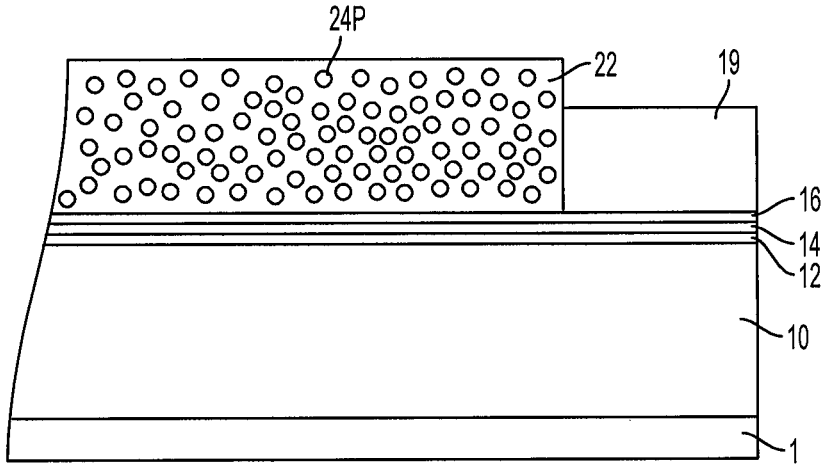
FIG. 6 is a cross-sectional view of an alternative flexible multilayered electrophotographic imaging member, having a single charge generating/transporting layer, prepared according to the present embodiments.

In the exemplary imaging member of the present disclosure shown in FIG. 6, the single imaging layer 22 is formed to include both the charge transport molecules and the photogenerating/photoconductive pigments dispersion in the disclosed polymer blended binder 24P comprising a polycarbonate and organic acid terminated A-B diblock copolymer prepared according to the descriptions previously detailed in the preceding embodiments.

It should be noted that in all of the above embodiments, the bisphenol polycarbonate and the A-B diblock copolymer present in the polymer blended binder 24P is in a weight ratio of polycarbonate to diblock copolymer of between about 10:90 and about 90:10 or between about 25:75 and about 75:25.

Imaging Member Having Photoelectrical Tune-Ability & Surface Lubricity

In the electrophotographic imaging members having photoelectrical tune-ability and surface lubricity, five imaging members (comprising of substrate 10, conductive ground plane 12, hole blocking layer 14, adhesive interface layer 16, charge generating layer 18, ground strip layer 16, charge transport layer 20 utilizing a binary polymer blended binder 24 of this disclosure, and an anticurl back coating for curl control) are prepared again in the same manners and with the same materials/compositions/thickness according to each of the preceding description of FIGS. 2 to 6, except that the disclosed polymer blended binder 24P (comprising of bisphenol polycarbonate and organic acid terminated A-B diblock copolymer in charge transport layer) is modified to include particles dispersion of a slippery nano silicon oxide Polyhedral Oligomeric Silsesquioxane (POSS) in the polymer blended binder material matrix. Thus, the same polymer blended binder 24P of FIGS. 2 to 6 is modified to include the addition of slippery POSS particle dispersion from about 5 to about 40% wt or from about 10 to 30% wt in the modified binder matrix based on the combined weight of the resulting polymer blended binder and POSS particle dispersion.

The Polyhedral Oligomeric Silsesquioxane (POSS)

Since the anatomy of a PUSS nanostructured chemical is based according to the general particle representation shown below, it does therefore have a wide variety of molecular structures:

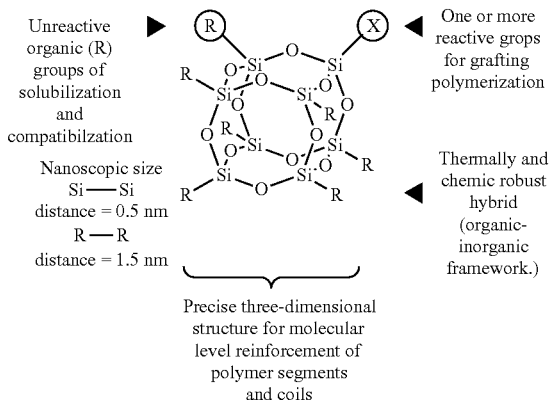

The POSS materials is a nano siliconoxide particles of between about 100 nanometers and about 5 nanometers in size. The slippery POSS of present application interest includes, for example, Cyclohexenyl-POSS; Cyclohexenyl-ethylCyclopenty-POSS; TriSilanol Phyenyl-POSS; OctaIsobutyl-POSS; PhenylIsooctyl Poss; IsooctylPhenyl Poss; IsobutylPhenyl Poss Poly(dimethyl-co-methyl-co-methylethylsiloxy POSS) siloxane; Poly(dimethyl-co-hydrido-co-methylpropyl POSS) siloxane; Methacrylfluoror(3)-POSS; and Cyclohexenyl-POSS; Poly(dimethyl-co-methyl-co-methylethylsiloxy POSS) siloxane; Poly(dimethyl-co-hydrido-co-methylpropyl POSS) siloxane; Fluoro(13)Disilanolisobutyl-POSS; and the like.

Other slippery POSS include poly(dimethyl-co-methylhydrido-co-methylpropyl polyhedral oligomeric silsequioxane) siloxane, fluoro(13)disilanolisobutyl-polyhedral oligomeric silsequioxane, poly(dimethyl-co-methylvinyl-co-methylethylsiloxy-polyhedral oligomeric silsequioxane)siloxane, trisfluoro(13)cylcopentyl-polyhedral oligomeric silsequioxane, fluoro(13)disilanolcyclopentyl-polyhedral oligomeric silsequioxane, fluoro(13)disilanolisobutyl-polyhedral oligomeric silsequioxane, fluoro(13)disilanolcyclopentyl-polyhedral oligomeric silsequioxane, and the like.

However, for reasons of simplicity, a selected few POSS species are shown in the following as representative examples:

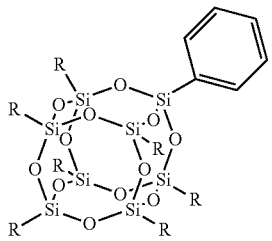

R = i-octyl

-continued

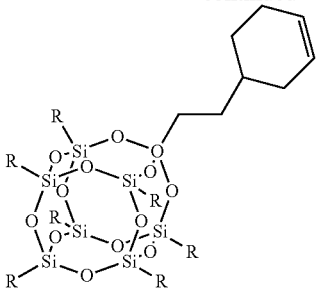

R = cyclopentyl

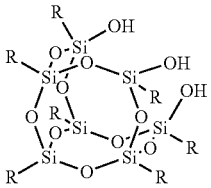

R = t-butyl, cyclopentyl, cyclohexyl, phenyl

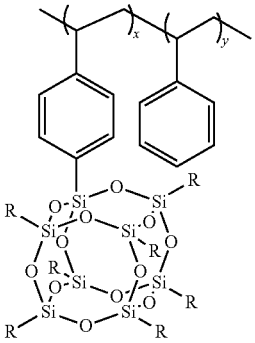

R = phenyl

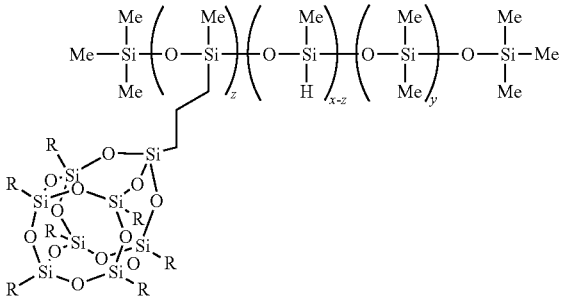

R = t-butyl, cyclopentyl, cyclohexyl, phenyl

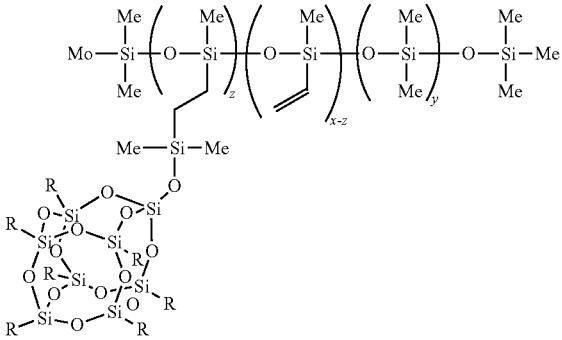

R = t-butyl, cyclopentyl, cyclohexyl, phenyl

-continued

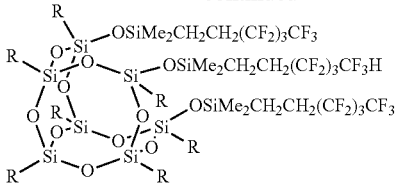

R = t-butyl, cyclopentyl

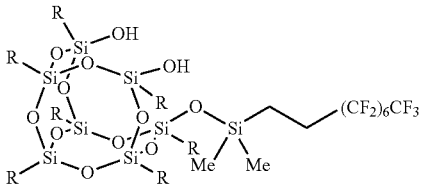

R = cyclopentyl

Photoelectrical Stable and Low Surface Energy Imaging Member

In the example of electrophotographic imaging member having photoelectrical stable and low surface energy property demonstration embodiments, five imaging members (comprising of substrate 10, conductive ground plane 12, hole blocking layer 14, adhesive interface layer 16, charge generating layer 18, ground strip layer 16, charge transport layer 20 utilizing a polymer blended binder 24 of this disclosure, and an anticurl back coating for curl control) are relatedly prepared in the very same manners, procedures, and using the exact same materials/compositions/thickness according to each description of FIGS. 2 to 6 in the preceding, but with the exception that the disclosed polymer blended binder 24P in the charge transport layer is then re-designed by blending a selected low surface energy copolymer and the same organic acid terminated A-B diblock copolymer. In other words, the polymer blended binder 24P in the charge transport layer of this disclosure has a re-designed composition formulated by blending a low surface energy polysiloxane/polycarbonate copolymer and the organic acid terminated A-B diblock copolymer to give two low surface energy polymer blended binder 24 re-designed compositions. Namely, the redesigned low surface energy polymer blended binder 24P is comprised of a polysiloxane/polycarbonate random copolymer and the organic acid terminated A-B diblock copolymer.

The Random Copolymers

The exemplary of a low surface energy material component for the re-designed polymer blended binder formulation is a random copolymer consisting of a modified bisphenol A polycarbonate of poly(4,4'-isopropylidene diphenyl carbonate) having a small fraction of polydimethyl siloxane randomly dispersed along in the linear polycarbonate chain back bone; it has the following formula:

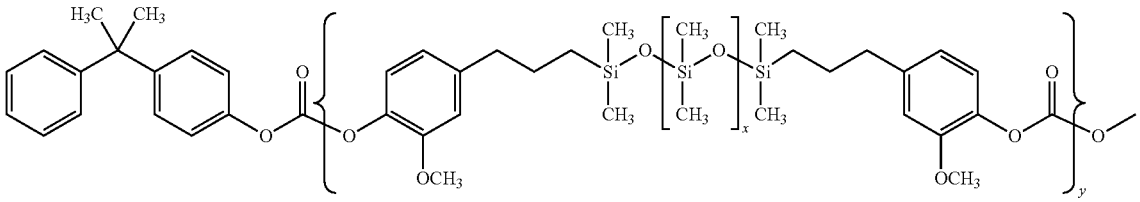

-continued

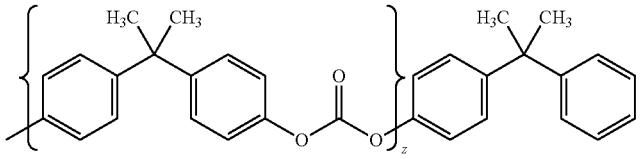

wherein x is an integer between about 40 and about 50 while y and z are integers representing a number of the respective repeating units; a modified bisphenol Z polycarbonate of poly(4,4'-diphenyl-1,1'-cyclohexane carbonate) having a small fraction of polydimethyl siloxane in the polymer chain back bone and having the formula shown below:

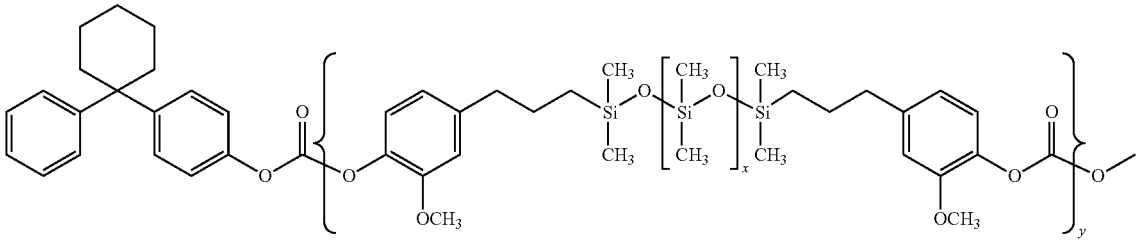

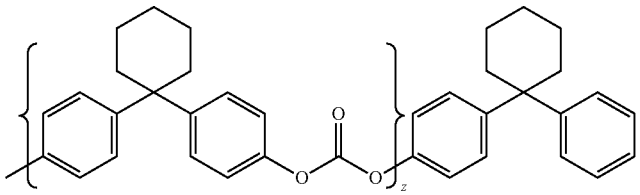

wherein x is an integer between about 40 and about 50 while y and z are integers representing a number of the respective repeating units; a modified bisphenol C polycarbonate derived from the modification of poly(4,4'-isopropylidene diphenyl carbonate) having a small fraction of polydimethyl siloxane in the polymer back bone and has the formula of:

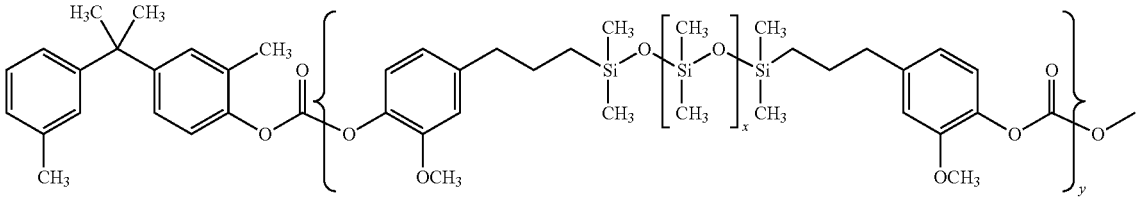

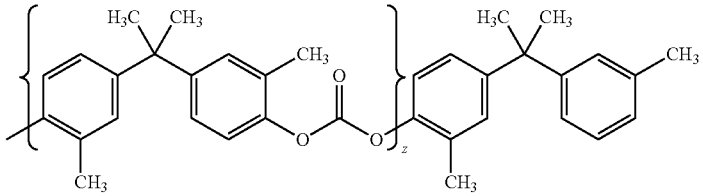

wherein x is an integer between about 40 and about 50 while y and z are integers representing a number of the respective repeating units; and a modification of the modified bisphenol Z polycarbonate of poly(4,4'-diphenyl-1,1'-cyclohexane carbonate), it has a small fraction of a short polydimethyl siloxane segment homogeneously inserted in the polymer back bone, to give the following formula:

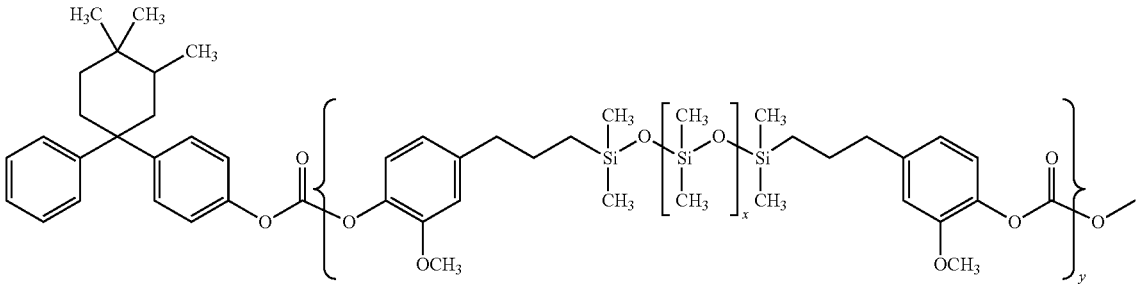

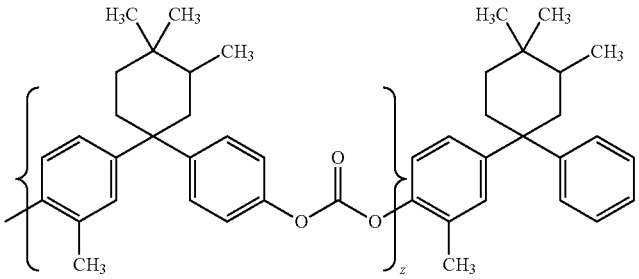

wherein x is an integer between about 40 and about 50 while y and z are integers representing a number of the respective repeating units, and mixtures thereof. In all the above formulas of the low surface energy random copolymer, the respective repeating units of y is between about 1 and about 6 and z is between about 9 and about 54. The weight average molecular weight of the low surface energy siloxane/bisphenol type random copolymers of the above formulas is between about 20,000 and about 200,000. Thus, the redesigned low surface energy polymer blended binder 24P is formed to comprise of a grafted polycarbonate/polysiloxane copolymer and the organic acid terminated A-B diblock copolymer.

The Graft Copolymers

Another low surface energy polymer selected is a graft copolymer, such as those shown in the following formulas; comprising a polyalkyl siloxane or a polyalkyl-polyaryl siloxane having a polycarbonate pendant group grafted to the polysiloxane chain back bone as shown below:

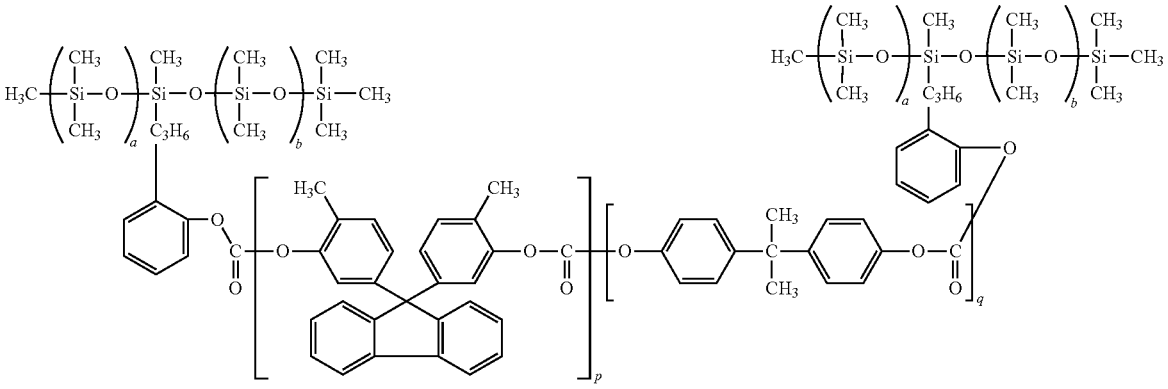

wherein a, b, p and q are integers representing a number of repeating units;
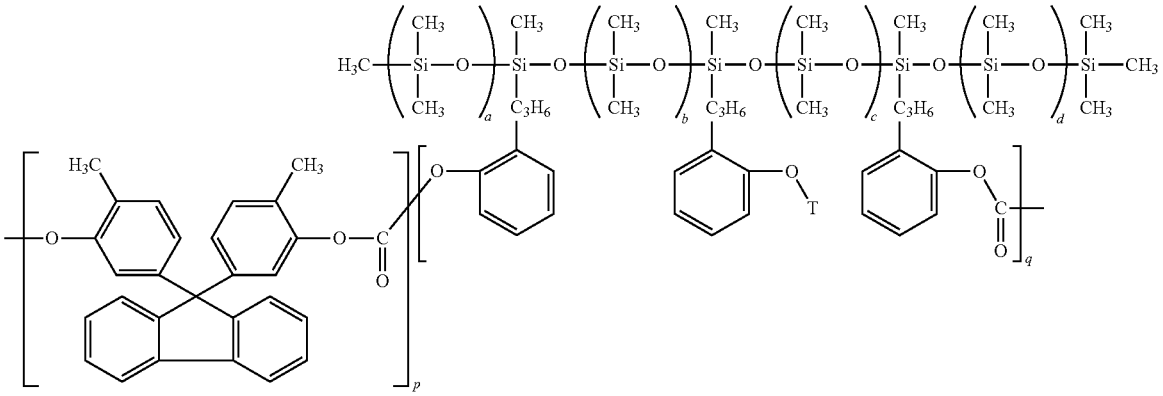
wherein a, b, c, d, p and q are integers representing a number of repeating units;
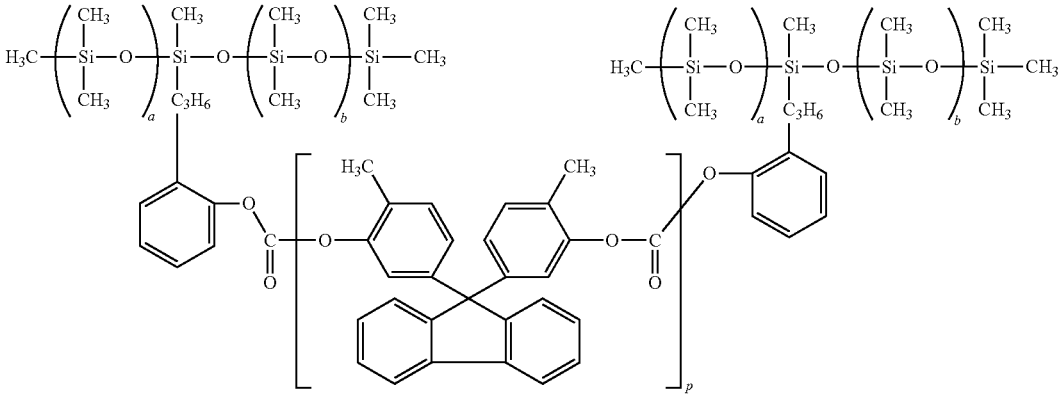
wherein a, b and p are integers representing the number of repeating units;
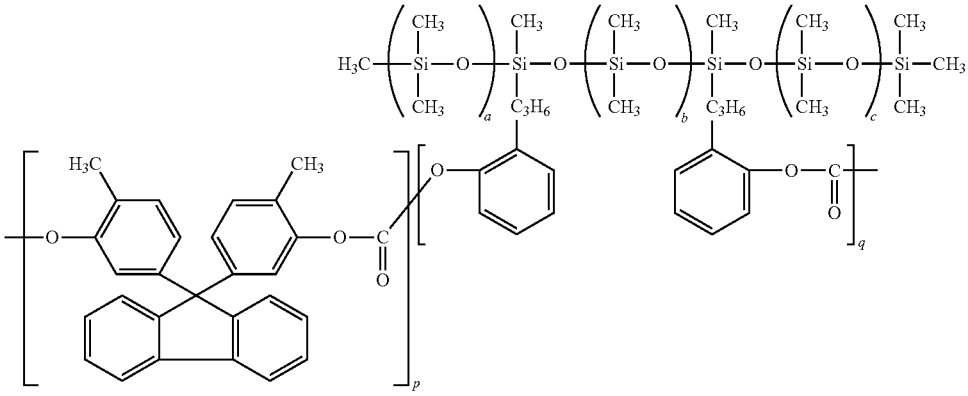
wherein a, b, c, p and q are integers representing the number of repeating units;

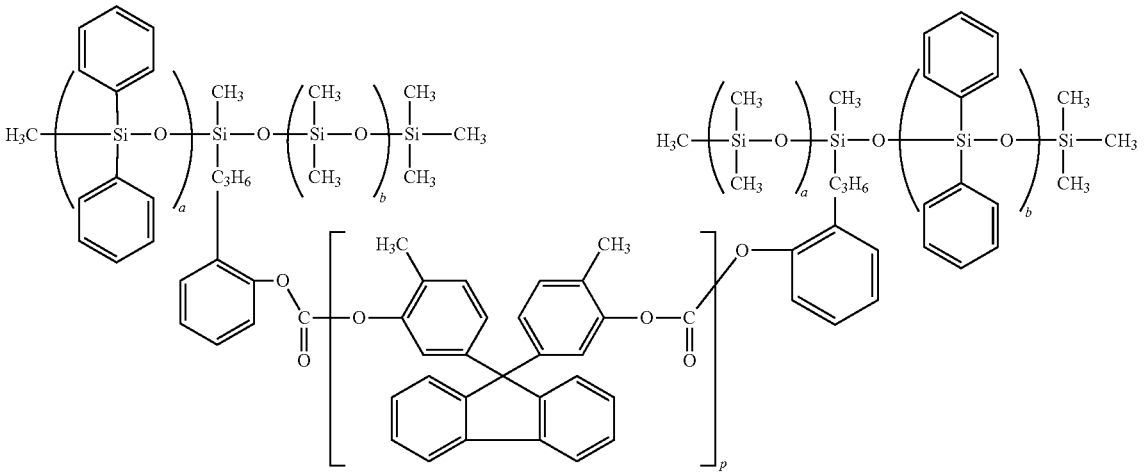

wherein the polymer has an polyalkyl and polyaryl siloxane main chain, and wherein a, b and p are integers representing the number of repeating units;

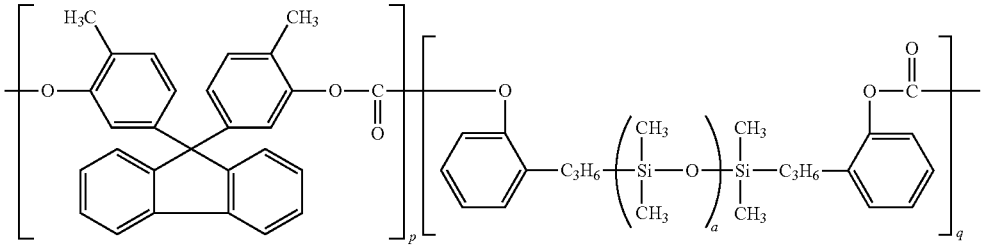

wherein a, p and q are integers representing the number of repeating units; and

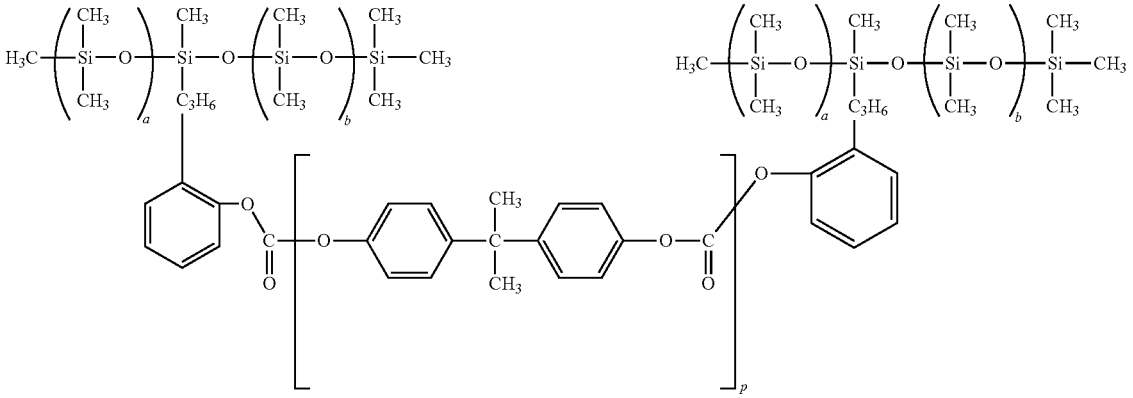

wherein a, b and p are integers representing the number of repeating units. The weight average molecular weight of the low surface energy poly carbonates of the above formulas is between about 20,000 and about 200,000.

The re-resigned low surface polymer blended binder 24P, prepared to contain either a low surface energy random copolymer or a low surface energy graft copolymer in each charge transport layer of the preceding imaging member embodiments, is comprised of a weight ratio of the low surface energy copolymer to the diblock copolymer of between about 5:95 and about 50:50 or between about or 10:90 and about 30:70 to provide the resulting charge transport layer with effective chemical amine protection as well as surface slipperiness for rendering surface contact friction reduction and minimizing wear/scratch failure.

All the flexible imaging members disclosed above, have good interfacial adhesion bonding between charge transport layer and charge generation layer and preserved the overall photoelectrical integrity with less cycle instability performance with respect to imaging member control. That means, for example, the imaging member have charge acceptance ($V_0$) in a range of from about 700 to about 850 volts; sensitivity (S) of between about 350 and about 400 volts/ergs/cm$^2$; residual potential ($V_T$) of less than about 100 volts; a depletion potential (Vdepl) of less than 90 volts. The disclosed imaging members had shown better stable discharge potential after exposure (Ve) and lower photo-induced discharge characteristic (PIDC) cycle-up compared to that of the control imaging member counterpart.

Additives

The resulting charge transport layer prepared according to the description of present disclosure (only the top exposed layer of the multiple layers) may also contain a light shock resisting or reducing agent of from about 1 to about 6 weight percent, based on the total weight of the resulting charge transport layer. Such light shock resisting agents include 3,3',5,5'-tetra(t-butyl)-4,4'-diphenoquinone (DPQ); 5,6,11,12-tetraphenyl naphthacene (Rubrene); 2,2'-{cyclohexylidenebis[(2-methyl-4,1-phenylene)azo]}bis[4-cyclohexyl-(9Cl)]; perinones; perylenes; and dibromo anthanthrone (DBA).

Additional aspects relate to the inclusion in the charge transport layer of variable amounts of an antioxidant, such as a hindered phenol. Exemplary hindered phenols include octadecyl-3,5-di-tert-butyl-4-hydroxyhydrociannamate, available as IRGANOX I-1010 from Ciba Specialty Chemicals. The hindered phenol may be present at about 10 weight percent based on the concentration of the charge transport component. Other suitable antioxidants are described, for example, in above-mentioned U.S. application Ser. No. 10/655,882 incorporated by reference.

To further improve the disclosed imaging member's mechanical performance, the top charge transport layer, being a single layer or multiple layers, may also include the additive of inorganic or organic fillers to impart greater wear resistant enhancement. Inorganic fillers may include, but are not limited to, silica, metal oxides, metal carbonate, metal silicates, and the like. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nano-sized inorganic or organic particles can be used in the fillers to achieve mechanical property reinforcement. One suitable particulate dispersion is described in U.S. Pat. No. 6,326,111, which is hereby incorporated by reference in its entirety.

The flexible multilayered electrophotographic imaging member fabricated in accordance with the embodiments, described in all the above preceding, may be cut into rectangular sheets. A pair of opposite ends of each imaging member cut sheet is then brought overlapped together thereof and joined by any suitable means, such as ultrasonic welding, gluing, taping, stapling, or pressure and heat fusing to form a continuous imaging member seamed belt, sleeve, or cylinder.

A prepared flexible imaging belt thus may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

Furthermore, a prepared electrophotographic imaging member belt can additionally be evaluated by printing in a marking engine into which the belt, formed according to the exemplary embodiments, has been installed. For intrinsic electrical properties it can also be determined by conventional electrical drum scanners. Additionally, the assessment of its propensity of developing streak line defects print out in copies can alternatively be carried out by using electrical analyzing techniques, such as those disclosed in U.S. Pat. Nos. 5,703,487; 5,697,024; 6,008,653; 6,119,536; and 6,150,824, which are incorporated herein in their entireties by reference. All the patents and applications referred to herein are hereby specifically, and totally incorporated herein by reference in their entirety in the instant specification.

All the exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

EXAMPLES

The development of the presently disclosed embodiments will further be demonstrated in the non-limiting working examples below. They are, therefore in all respects, to be considered as illustrative and not restrictive nor limited to the materials, conditions, process parameters, and the like recited herein. The scope of embodiments is being indicated by the appended claims rather than the foregoing description. All changes that come within the meaning of and range of equivalency of the claims are intended to be embraced therein. All proportions are by weight unless otherwise indicated.

Control Imaging Member Preparation Example

A conventional negatively charged flexible electrophotographic imaging member web (as that illustrated in FIG. 1) was prepared by providing a 0.02 micrometer thick titanium layer 12 coated substrate of a biaxially oriented polyethylene naphthalate substrate 10 (PEN, available as KADALEX from DuPont Teij in Films) having a thickness of 3½ mils (89 micrometers), and extrusion coating the titanized KADALEX substrate with a blocking layer solution containing a mixture of 6.5 grams of gamma aminopropyltriethoxy silane, 39.4 grams of distilled water, 2.1 grams of acetic acid, 752.2 grams of 200 proof denatured alcohol and 200 grams of heptane. The resulting wet coating layer was allowed to dry for 5 minutes at 135° C. in a forced air oven to remove the solvents from the coating and effect the formation of a crosslinked silane blocking layer. The resulting blocking layer 14 had an average dry thickness of 0.04 micrometer as measured with an ellipsometer.

An adhesive interface layer 16 was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuranl-monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge generating layer. The charge generating layer (CGL 18) dispersion was prepared as described below:

To a 4 ounce glass bottle was added IUPILON 200, a polycarbonate of poly(4,4'-diphenyl)-1,1'-cyclohexane carbonate (PC-z 200, available from Mitsubishi Gas Chemical Corporation) (0.45 grams), and tetrahydrofuran (50 milliliters), followed by hydroxygallium phthalocyanine Type V (2.4 grams) and ⅛ inch (3.2 millimeters) diameter stainless steel shot (300 grams). The resulting mixture was placed on a ball mill for about 20 to about 24 hours to obtain a slurry. Subsequently, a solution of poly(4,4'-diphenyl-1,1'-cyclohexane carbonate) (2.25 grams) having a weight average molecular weight of 20,000 (PC-z 200) dissolved in tetrahydrofuran (46.1 grams) was added to the hydroxygallium phthalocyanine slurry. The resulting slurry was placed on a shaker for 10 minutes and thereafter coated onto the adhesive interface 16 by extrusion application process to form a layer having a wet thickness of 0.25 mil. A strip of about 10 millimeters wide along one edge of the substrate web stock bearing the blocking layer 14 and the adhesive layer 16 was deliberately left uncoated by the CGL 18 to facilitate adequate electrical contact by a ground strip layer to be applied later. The resulting CGL 18 containing poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web stock was simultaneously coated over with a charge transport layer (CTL 20) and a ground strip layer 19 by co-extrusion of the coating materials. The CTL was prepared as described below:

To an amber glass bottle was added bisphenol A polycarbonate thermoplastic having an average molecular weight of about 120,000 (FPC 0170, commercially available from Mitsubishi Chemicals) and a charge transport compound of N,N'-diphenyl-N,N'-bis(3-methylphenyl)-1,1'-biphenyl-4,4'-diamine. The weight ratio of the bisphenol A polycarbonate thermoplastic and N,N'-diphenyl-N,N'-bis(3-methylphenyl)-1,1'-biphenyl-4,4'-diamine was 1:1. The resulting mixture was dissolved in methylene chloride such that the solid weight percent in methylene chloride was 15 percent by weight. Such mixture was applied on the CGL 18 by extrusion to form a coating which upon drying in a forced air oven gave a dry CTL 20 of 29 micrometers thick. The strip, about 10 millimeters wide, of the adhesive layer 16 left uncoated by the CGL 18, was coated with a ground strip layer 19 during the co-extrusion process. The ground strip layer coating mixture was prepared as described below:

To a carboy container was added 23.8 grams of bisphenol A polycarbonate resin (FPC 0170) and 332 grams methylene chloride. and methylene chloride (332 grams). The container was covered tightly and placed on a roll mill for about 24 hours until the polycarbonate was dissolved and gave a 7.9 percent by weight solution. The prepared solution was mixed for 15-30 minutes with about 94 grams of graphite dispersion solution (available as RW22790, from Acheson Colloids Company) to give ground strip layer coating solution. (Note: The graphite dispersion solution, RW22790 as commercially obtained, contained a 12.3 percent by weight solids including 9.41 parts by weight of graphite, 2.87 parts by weight of ethyl cellulose, and 87.7 parts by weight of solvent).

To achieve homogeneous graphite dispersion, the resulting ground strip layer coating solution was then mixed with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL solution, to the electrophotographic imaging member web to form an electrically conductive ground strip layer 19 having a dried thickness of about 19 micrometers.

The imaging member web stock containing all of the above layers was then passed through 125° C. in a forced air oven for 3 minutes to simultaneously dry both the CTL 20 and the ground strip 19. Since the CTL has a Young's Modulus of $3.5\times10^5$ psi ($2.4\times10^4$ Kg/cm$^2$) and a thermal contraction coefficient of $6.5\times10^{-5}$/° C. compared to the Young's Modulus of $5.5\times10^5$ psi ($3.8\times10^4$ Kg/cm$^2$) and thermal contraction coefficient of $1.8\times10^{-5}$/for the PEN substrate support 10, the CTL 20 was about 3.6 times greater in dimensional shrinkage than that of PEN substrate support. Therefore, the imaging member web if unrestrained at this point would curl upwardly into a 1½-inch tube.

To effect imaging member curl control, a conventional anticurl back coating (ACBC) 1 was prepared by combining 88.2 grams of FPC 0170 bisphenol A polycarbonate resin, 7.12 grams VITEL PE-2200 copolyester (available from Bostik, Inc. Middleton, Mass.), and 1,071 grams of methylene chloride in a carboy container to form a coating solution containing 8.2 percent solids. The container was covered tightly and placed on a roll mill for about 24 hours until the polycarbonate and polyester were dissolved in methylene chloride to form an anti-curl back coating solution. The ACBC coating solution as prepared was then applied to the rear surface (side opposite to the charge generating layer and CTL) of the electrophotographic imaging member web by extrusion coating and dried to a maximum temperature of 125° C. in a forced air oven for about 3 minutes to produce a dried ACBC 1 having a thickness of 17 micrometers and flattening the imaging member.

Disclosure Imaging Member Preparation Example I

Photoelectrical Tunability

Four negatively charged flexible electrophotographic imaging member webs, as that illustrated in FIG. 2, were prepared with the same procedures and material compositions as those disclosed in the above Control Imaging Member Preparation Example, but with the exception that the conventional charge transport layer (CTL) 20 was re-designed by replacing the bisphenol A polycarbonate binder in the CTL 20 with a polymer blended binder 24P consisting of bisphenol A polycarbonate and an organic acid terminated A-B diblock copolymer in three different blending weight ratios. So the weight ratios of bisphenol A polycarbonate to the diblock copolymer used to form the polymer blended binder 24P were 0/100; 25:75; 50:50; and 75:25 in each respective CTL of these imaging members. The bisphenol A polycarbonate (PCA available as FPC 0170 from Mitsubishi Chemicals Corp.) had a weight average molecular weight of about 120,000 and a molecular formula of

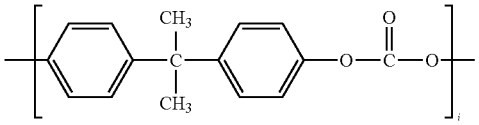

(bisphenol A polycarbonate)

wherein j, the degree of polymerization, is a positive integer of between about 50 and about 200.

The A-B diblock copolymer (Lexan HLX available from Sabic Innovative Plastics) comprises two segmental blocks of a bisphenol A polycarbonate ($C_{16}H_{14}O_3$) and a phthalic acid terminal capable of providing protection against amine species contaminants exposure. It has as a molecular formula shown below:

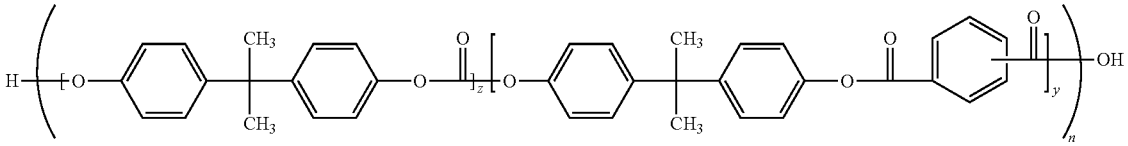

Block (A) Block (B)

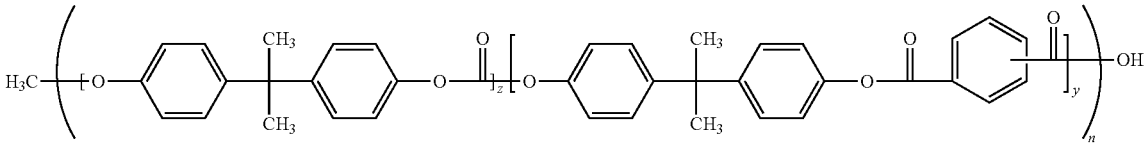

Block (A) Block (B)

wherein z represents the number of bisphenol A repeating units in block A and is from about 9 to about 18, y represents the number of repeating phthalic acid in block B and is from about 1 to about 2, and n represents the degree of polymerization of di-block copolymer and is from about 20 to about 80, and mixtures thereof.

The Lexan HLX A-B diblock copolymer was a high molecular film forming polymer. It had a weight average molecular weight (Mw) of about 175,000 to impart mechanical strength and was highly miscible with the bisphenol A polycarbonate to facilitate the formulation of a polymer blended binder of this disclosure. The Lexan HLX A-B diblock copolymer is also very compatible with charge transport compound of N,N'-diphenyl-N,N'-bis(3-methylphenyl)-1,1'-biphenyl-4,4'-diamine as well to provide the formation of solid solution CTL.

Figure 7:
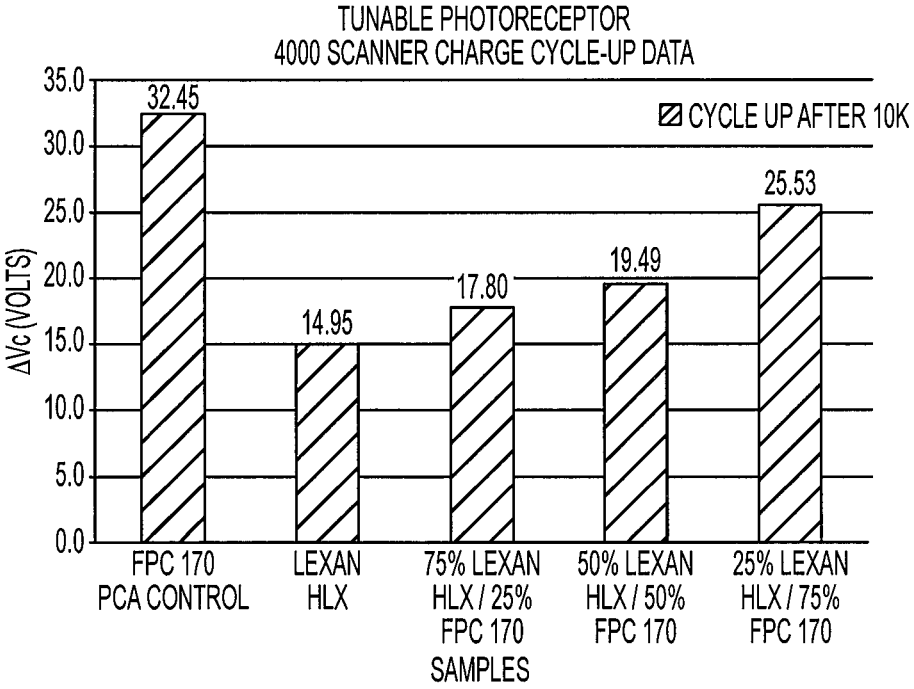
FIG. 7 is a graph illustrating the results of an evaluation of photoelectrical function of four imaging webs made according to the present embodiments and a control imaging web.
Figure 8:
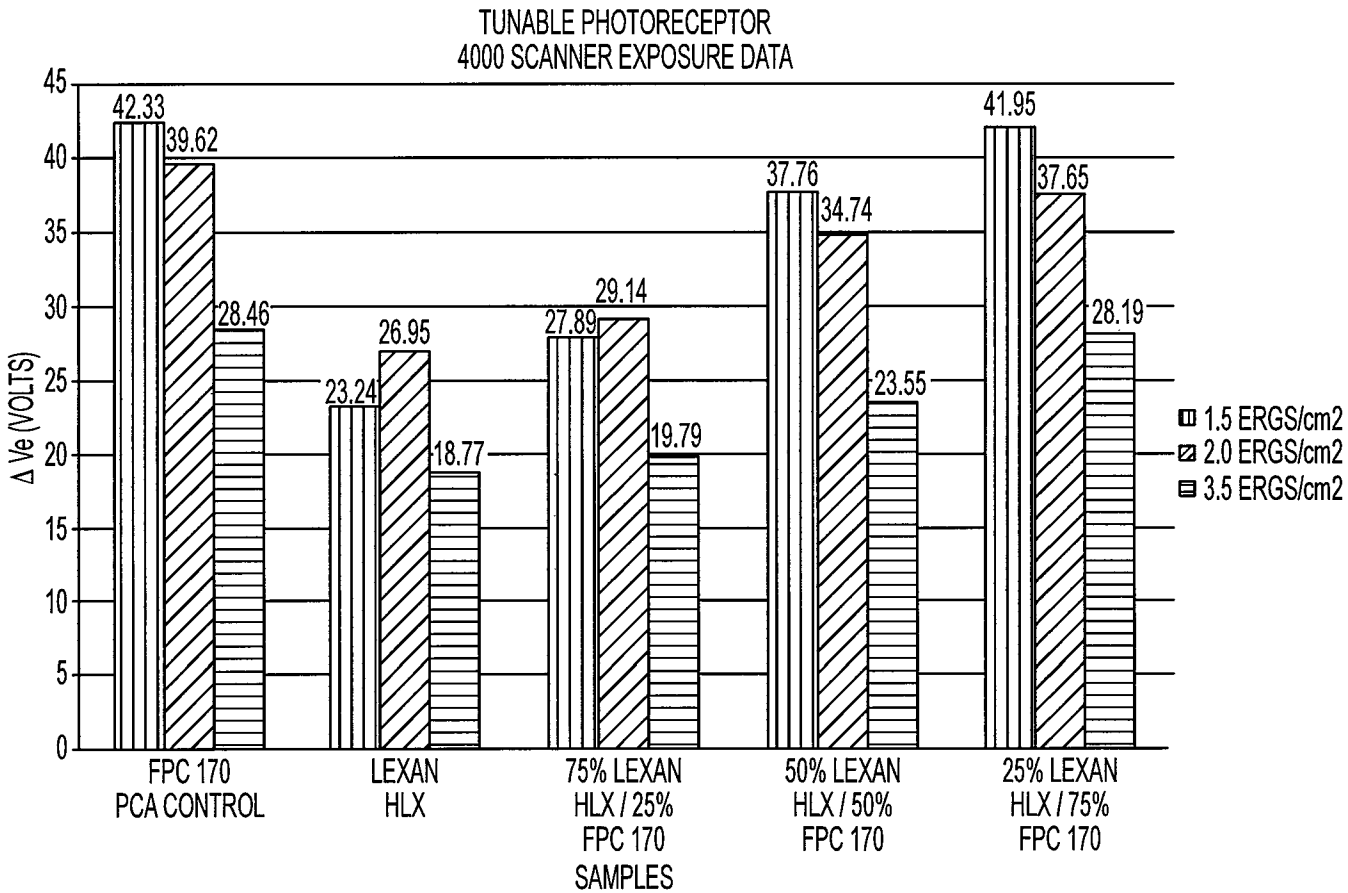
FIG. 8 is a graph illustrating the results of an evaluation of cyclic stability/tune-ability of four imaging webs made according to the present embodiments and a control imaging web.

The four imaging member webs, as prepared to contain the polymer blended binder 24P in each respective CTL 20 of this disclosure, were evaluated along the control imaging member for their photoelectrical function and cyclic stability/tunability, using the 40,000 lab. scanner, up to 10,000 electrical cycles of constant current test. The test results obtained (shown in FIGS. 7 and 8 in the following) had indicated that the imaging members utilizing a polymer blended binder 24P consisting of bisphenol A polycarbonate (FPC 0170) and A-B diblock copolymer in the CTL 20 re-designed were more photo-electrically stable as reflected in less cycle-up in both charge level before exposure (Vc) and discharge after exposure (Ve) than those value obtained for the control imaging member counterpart using a conventional CTL containing a bisphenol A polycarbonate (FPC 0170) binder. Photo-electrical tunability of both Vc and Ve was notably evident by varying the blending weight ratios of bisphenol A polycarbonate (FPC 0170) to A-B diblock copolymer in the formulation of polymer blended binder 24P. That means these the Vc and Ve can easily be tuned and controlled accordingly, to give any desirable electrical cycle-up or down behavior that meets each specific xerographic machine requirement, by simply adjusting the polymer blending ratio of these 2 polymer components in formulating the polymer blended binder 24P of the CTL.

Disclosure Imaging Member Preparation Example II

Photoelectrical Stable & Low Surface Energy

A negatively charged flexible electrophotographic imaging member web was likewise prepared to use the exact same procedures and material compositions as described in the imaging member disclosure of FIG. 2; that means it comprises a flexible substrate 10, a conductive ground plane layer 12 a silane blocking layer 14, an adhesive interface layer 16, a ground strip layer 19, a CGL 18, a CTL 20 comprising N,N'-diphenyl-N,N'-bis(3-methylphenyl)-1,1'-biphenyl-4,4'-diamine and polymer blended binder 24P disposed on the CGL 18, and an ACBC 1 applied to the opposite side of the substrate 10 to render imaging member flatness. However, it was with the exception that the polymer blended binder 24P used in the CTL 20 was then a reformulation blend comprising of 75% wt A-B diblock copolymer and 25% wt of a random siloxane/polycarbonate copolymer. The random siloxane/polycarbonate copolymer to be used was a low surface energy material having a linear molecular structure representation shown below:

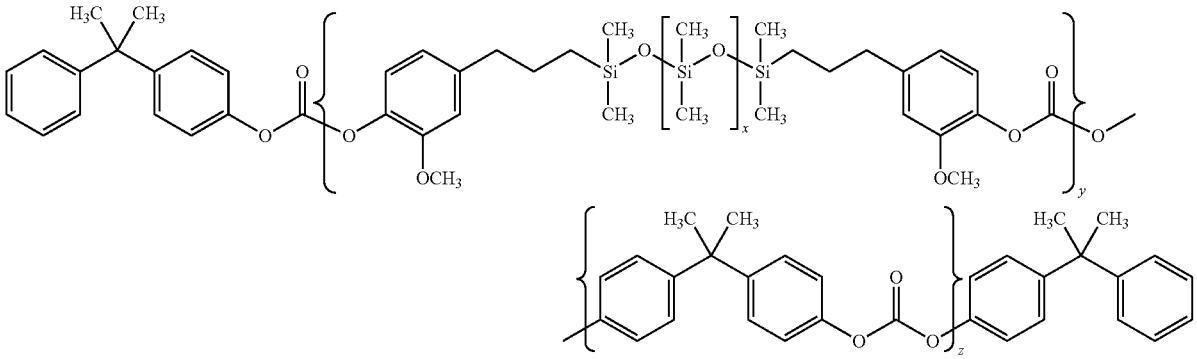

wherein x is an integer between about 40 and about 50, while the respective repeating units of y is between about 1 and 6 and z is between about 9 and about 54.

In this very specific Disclosure Example, the low surface energy random copolymer selected for CTL 20 polymer blended binder 24P formulation was Lexan EXL 1463C (available from Sabic Innovative Plastics). It had a weight molecular weight of about 25,000 and was highly miscible with the A-B diblock copolymer to facilitate polymer blending and was also very compatible with the charge transport compound of N,N'-diphenyl-N,N'-bis(3-methylphenyl)-1,1'-biphenyl-4,4'-diamine to enable formation of a solid solution slippery/low surface energy CTL.

Photoelectrical and Physical/Mechanical Determinations

Figure 9:
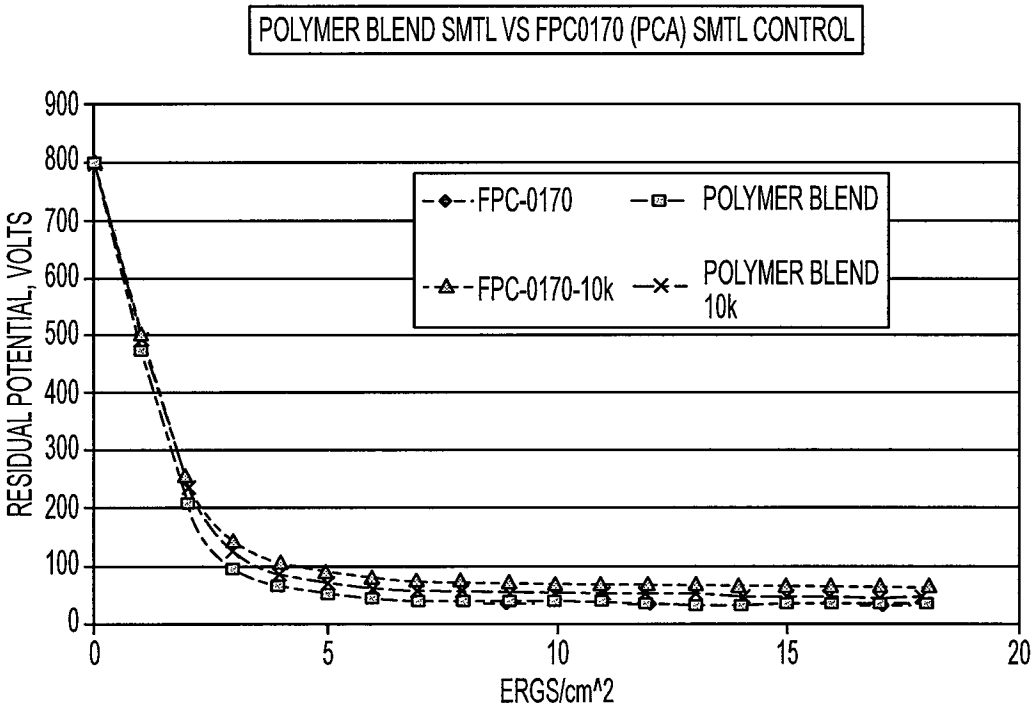
FIG. 9 is a photo-induced discharge curve (PIDC) plot of the four imaging webs made according to the present embodiments.

The photoelectrical properties of the imaging member containing the low surface energy polymer blended binder 24P obtained according to the Disclosure Imaging Member Preparation II described above was evaluated along the control imaging member for comparison, using the 40,000 lab. scanner, up to 10,000 electrical cycles of constant current test. The test results thus obtained (shown in Table 1 and FIG. 9 below) had confirmed that the imaging member web prepared to use the low surface energy polymer blended binder 24P reformulation, comprising of the A-B diblock copolymer and the siloxane/polycarbonate random copolymer blending in the disclosed CTL 20, had good overall photoelectrical stability and exhibited less Photo Induced Discharge Characteristic (PIDC) Cycle-up than that seen in the control imaging member web containing FPC 0170 (PCA) binder in the conventional CTL 20 formulation of prior art.

TABLE 1

| Imaging Member | CTL Binder Type | Vo | S | Vc | Vr | $V_{e-6.0}$ | Vdepl | Vdd |
|---|---|---|---|---|---|---|---|---|
| Control | STD FPC (PCA) | 799 | 350 | 161 | 26.2 | 44.7 | 56.0 | −34.1 |
| Disclosure II | Polymer Blend | 799 | 332 | 166 | 26.5 | 47.6 | 53.6 | −35.0 |
| | after 10K cycles | | | | | | | |
| Control | STD FPC (PCA) | 799 | 331 | 195 | 45.6 | 74.1 | 104.7 | −54.1 |
| Disclosure II | Polymer Blend | 799 | 324 | 183 | 32.3 | 59.2 | 105.0 | −37.2 |

The CTL of the imaging member web of Disclosure Example II and that of the control imaging member web were optically examined to show that they had equivalent 99.9% light transmission by optical photometer measurement and excellent bonding each respective BGL. In addition, both the imaging member webs were further assessed for surface energy by water contact angle wetting determination, contact friction by sliding a polyurethane cleaning blade over each surface, and surface adhesiveness/release carried out by 180° 3M adhesive tape peel off strength measurement. The physical/mechanical testing results thereby obtained (tabulated in Table 2 below) had shown that the imaging member having the CTL, re-designed to utilize a low surface energy polymer blended binder of Disclosure Example II, had significant coefficient of sliding friction reduction against cleaning blade, effective surface energy lowering, and excellent surface adhesiveness (ease of release) as reflected by the extremely low 180° 3M tape peel-off strength, in comparison to those results determined for the control imaging member containing the conventional STD PCA binder counterpart in its CTL.

TABLE 2

| Imaging Member (CTL type) | Surface Energy (dynes/cm) | Coefficient of Friction (against blade) | Tape Peel off Strength (grams/cm) |
|---|---|---|---|
| Control | 32 | 1.21 | 246 |
| Disclosure II | 21 | 0.65 | 51 |

CONCLUSION

The flexible imaging member prepared according to the Disclosure Examples I as described in the above embodiments comprised a binary polymer blended binder 24P (consisting of a polycarbonate and an organic acid terminated A-B diblock copolymer in various disclosed weight ratios) in the charge transport layer(s). The imaging member of these embodiments provides: (1) protection against environmental chemical amine attack, such as for example, through acid-base chemical reaction of quenching/neutralization of the basic amine species and (2) photoelectrical tunability result obtained by simply adjusting or controlling the blending ratio of each polymer component to form a desirable polymer blended binder that could meet specific xerographic machine need for achieving copy quality, cost, and delivery objectives.

For the imaging member prepared according to the Disclosure Example II, having the respective charge transport layer(s) re-designed to use polymer blended binder 24P formulated to comprise of the A-B diblock copolymer and a low surface energy material component, in addition to providing photoelectrical stability function, these imaging members also provided the resulting charge transport layer with a surface energy lowering effect to impart surface contact friction reduction for enhancing the cleaning blade/cleaning brush functional efficiency, reduce the propensity of surface scratch/wear failure, and facilitate toner image transfer to receiving paper for copy quality improvement. In other words, the imaging member prepared to employed a binary polymer blended binder formulated according to the description of Disclosures I and II to give the abovementioned photoelectrical and physical/mechanical benefits impart imaging member service life extension in the field.

All the patents and applications referred to herein are hereby specifically, and totally incorporated herein by reference in their entirety in the instant specification. It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A flexible imaging member comprising:

a flexible substrate;

a charge generating layer disposed on a first side of the substrate; and at least one charge transport layer disposed on the charge generating layer, wherein the charge transport layer comprises a charge transport compound molecularly dispersed or dissolved in a binary polymer blend binder to form a solid solution, the polymer blend binder comprising a bisphenol polycarbonate and an organic acid containing A-B diblock copolymer having a general formula of $$R_1\text{-}(\text{[Block A]}_z\text{-[Block B]}_y)_n\text{OH}$$

wherein block A is a polycarbonate repeating unit, block B is an organic acid containing repeating unit, z is from about 9 to about 54, y is from about 1 to about 6, n is between about 20 and about 80, and $R_1$ is H or $CH_3$ and further wherein a weight ratio of the bisphenol polycarbonate to organic acid containing A-B diblock copolymer can be varied from about 10:90 to about 90:10 to tune photoelectrical function and cyclic stability of the flexible imaging member;

wherein the block A polycarbonate repeating unit in the A-B diblock copolymer is a bisphenol polycarbonate selected from the group consisting of Formula A-6

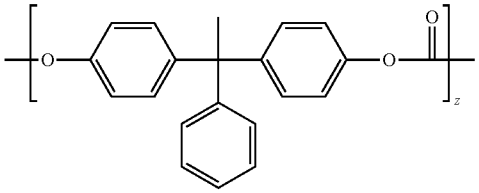

Formula A-7

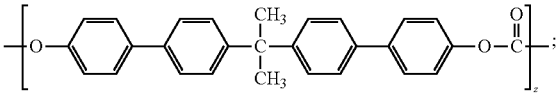

-continued

Formula A-8

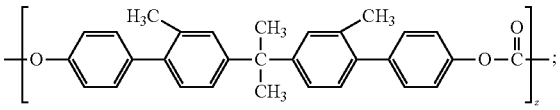

and

Formula A-9

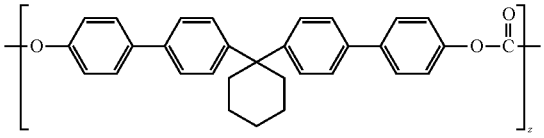

wherein z is an integer representing the numbers of repeating segmental carbonate unit, and is from about 9 to about 18, from about 27 to about 36, or from about 45 to about 54.

2. The flexible imaging member of claim 1, wherein the block B organic acid containing repeating unit in the A-B diblock copolymer is selected from the group consisting of:

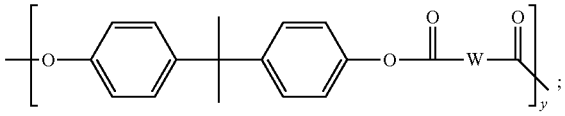

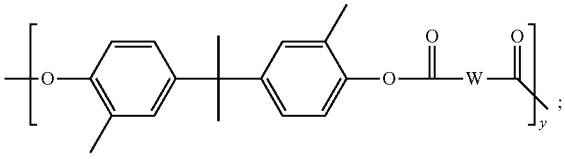

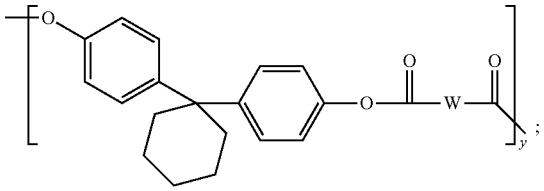

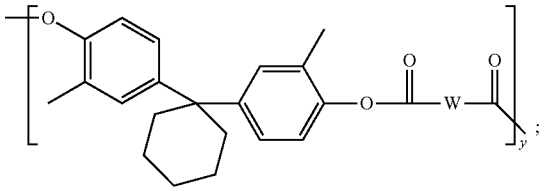

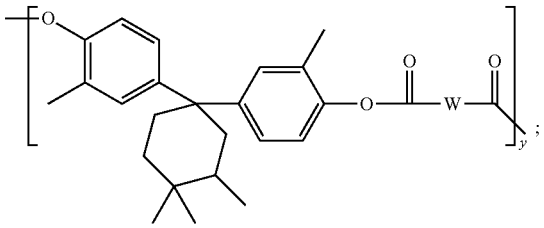

and

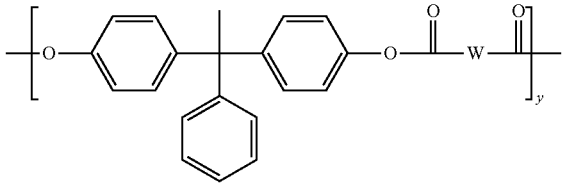

wherein W is an aromatic moiety or an aliphatic moiety, and y is from about 1 to about 6.

3. The flexible imaging member of claim 1, wherein the block B organic acid containing repeating unit in the A-B diblock copolymer is selected from the group consisting of:

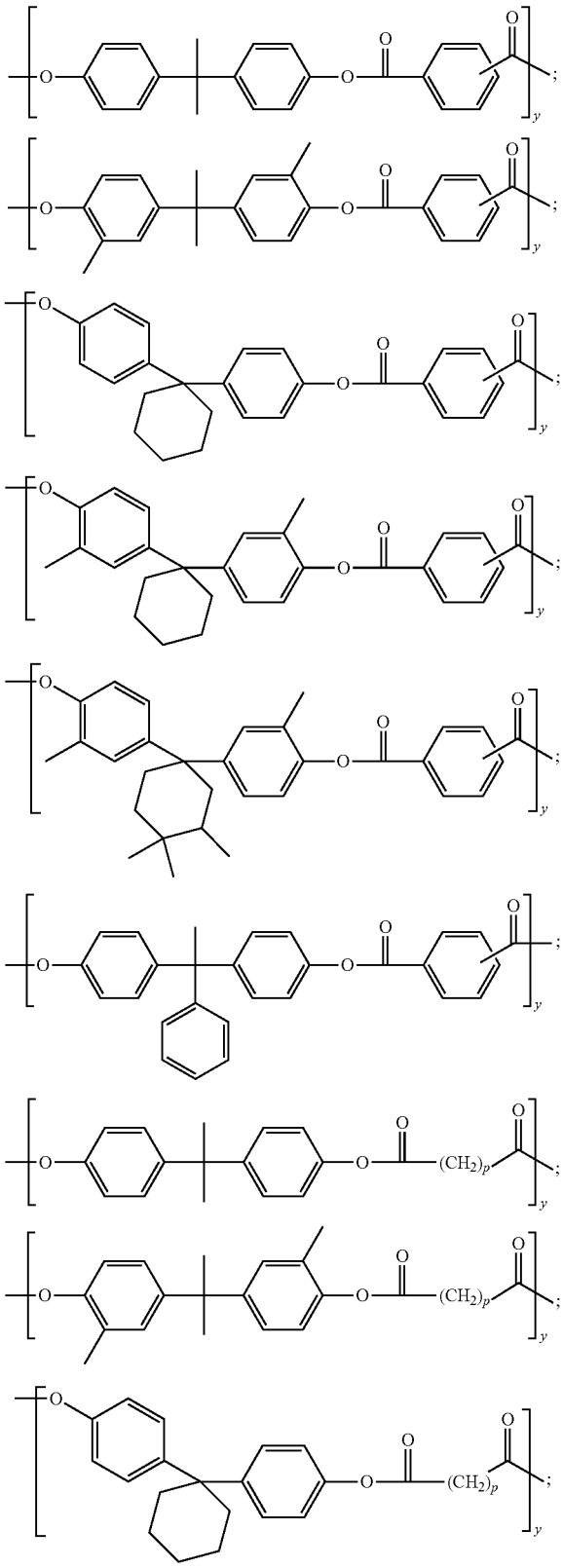

-continued

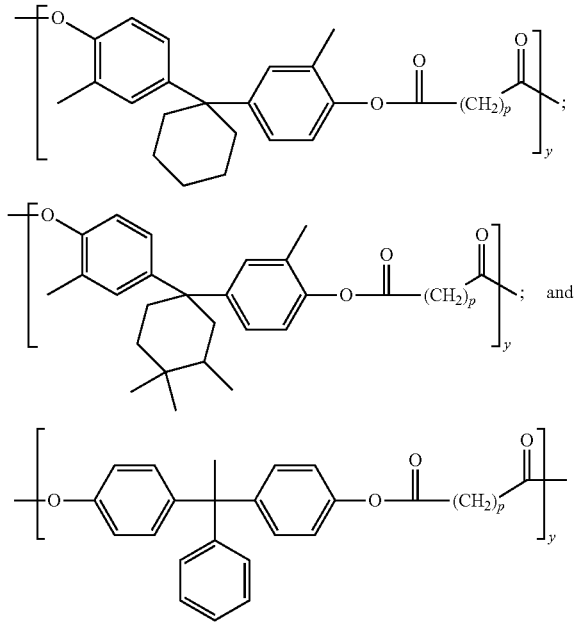

and wherein p is from 3 to 8 or from 4 to 6; and y is from about 1 to about 6.

4. The flexible imaging member of claim 1, wherein the block B organic acid containing repeating unit in the A-B diblock copolymer have dicarboxylic acid terminal units selected from the group consisting of:

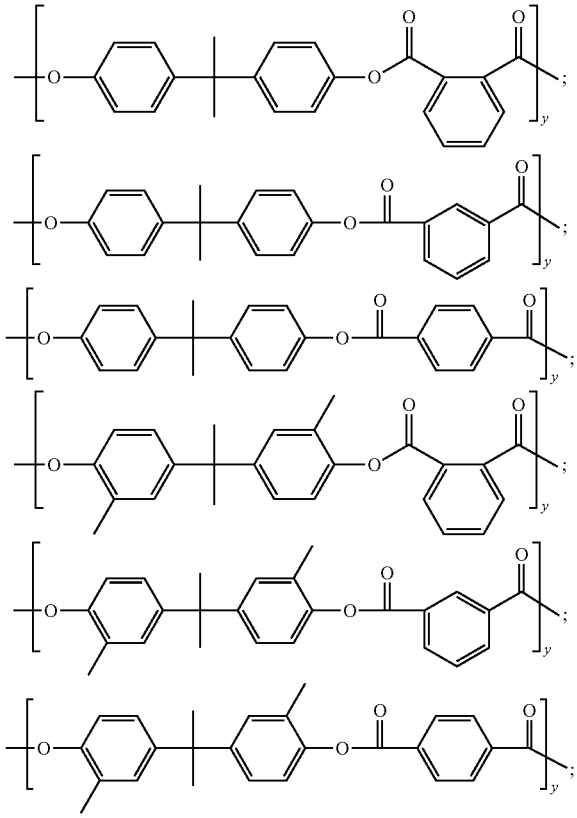

-continued
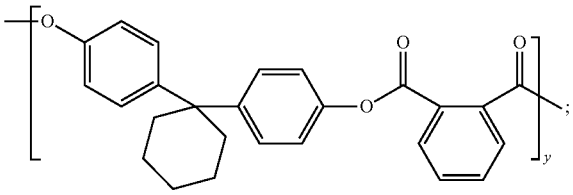
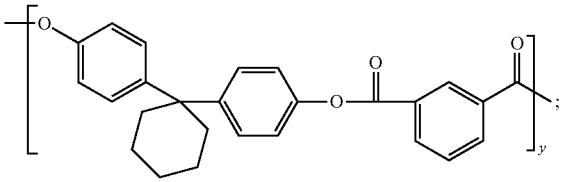
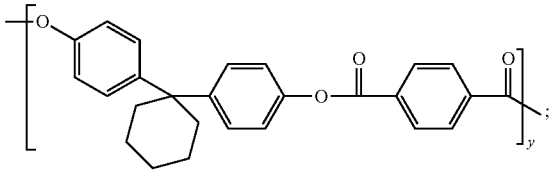
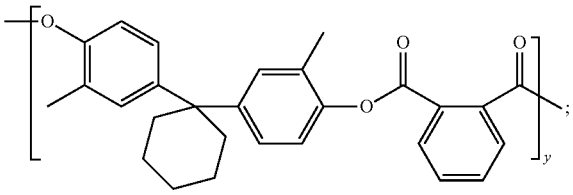
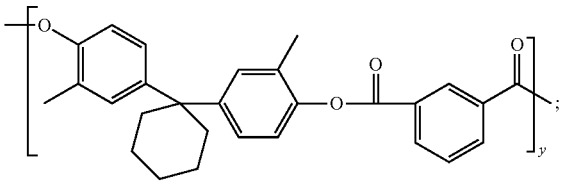
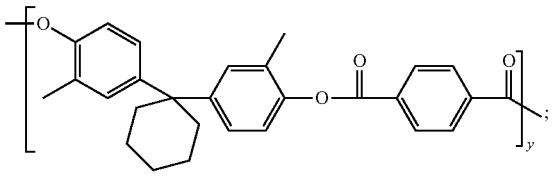
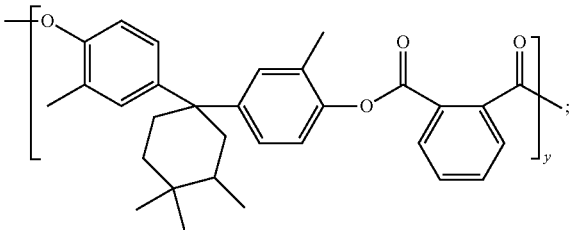
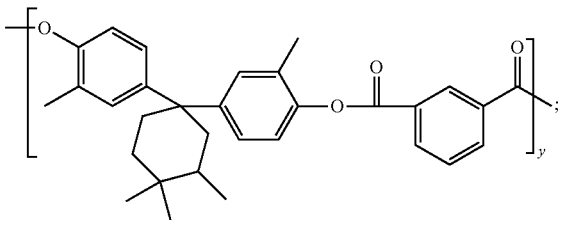
-continued
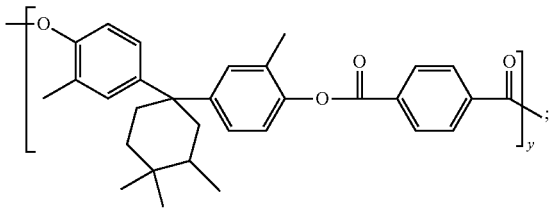
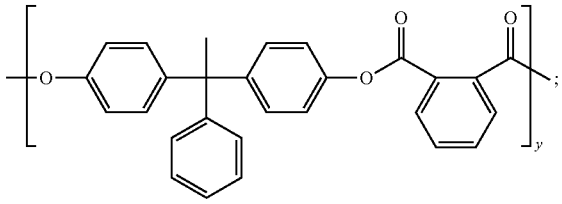
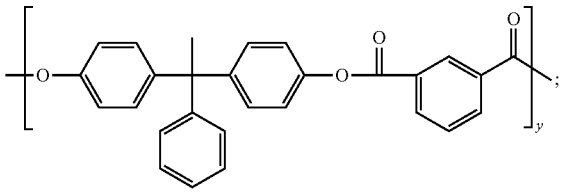
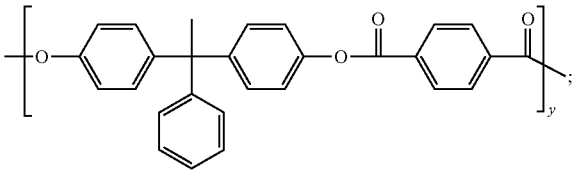
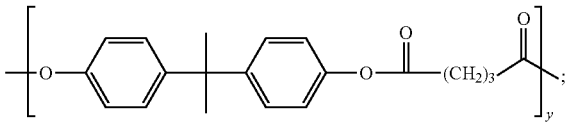
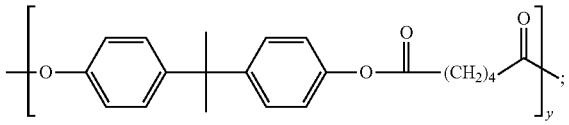
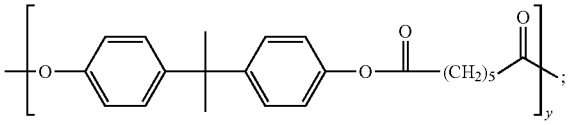
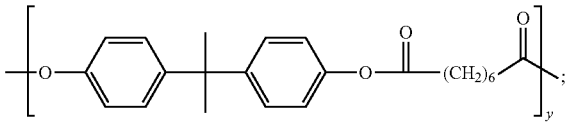
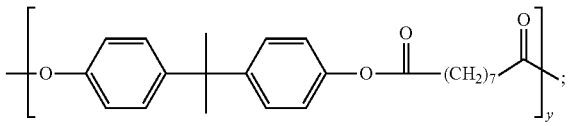
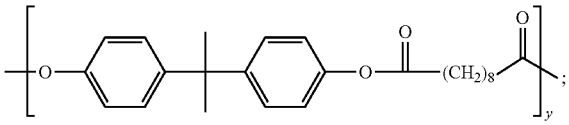
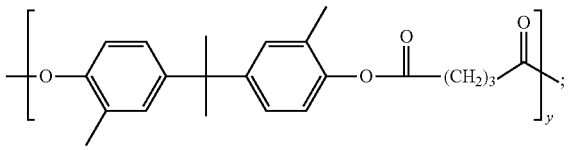

-continued
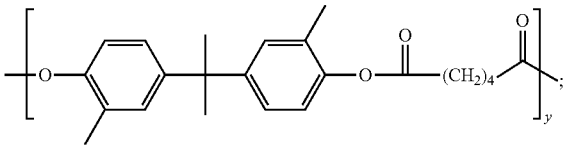
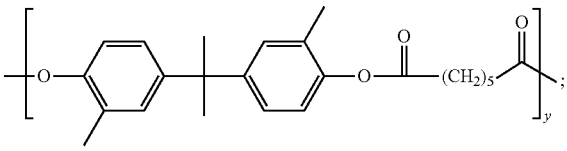
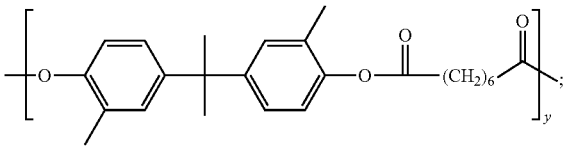
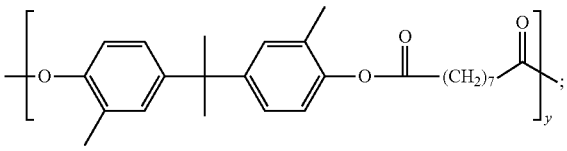
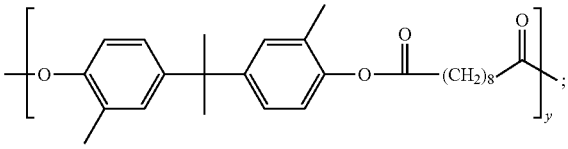
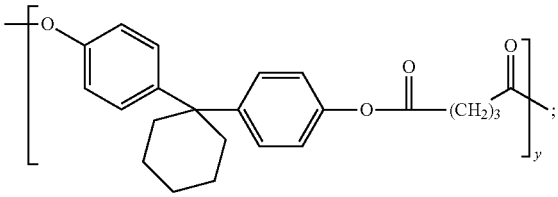
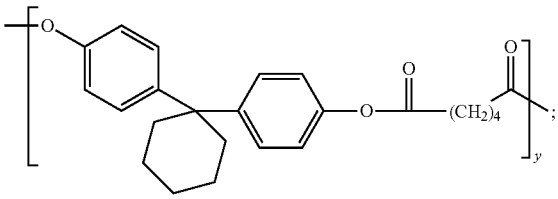
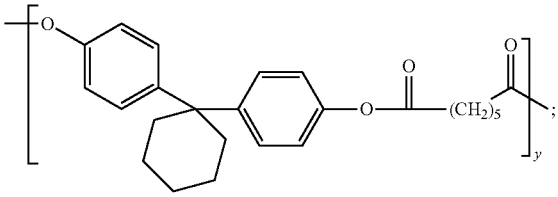
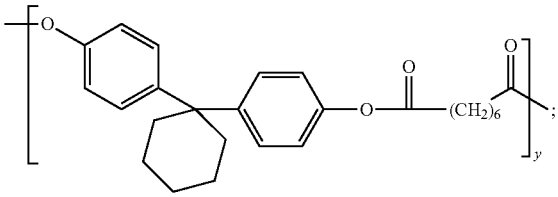
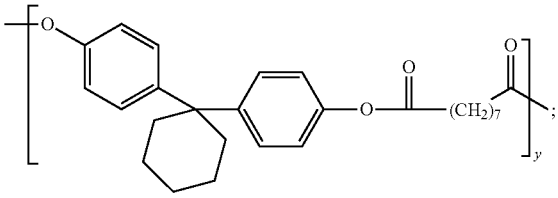
-continued
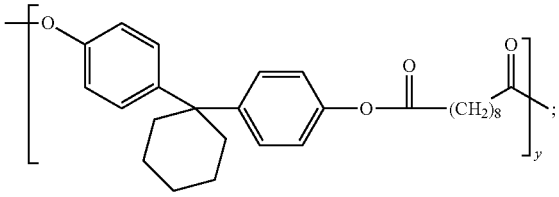
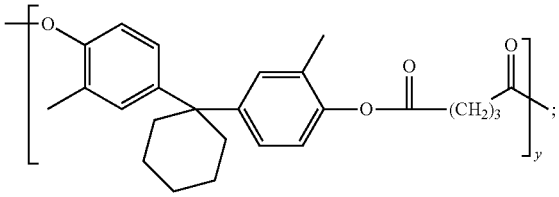
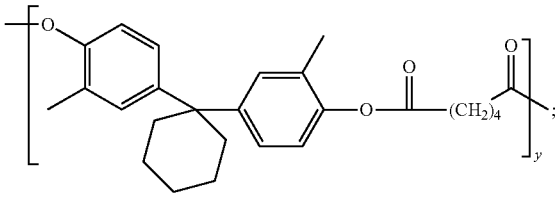
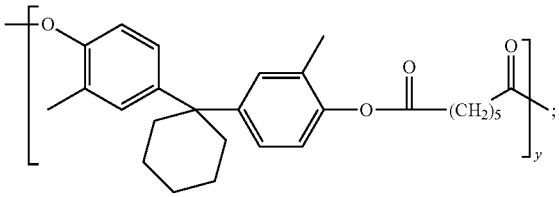
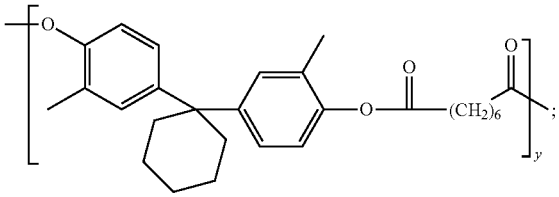
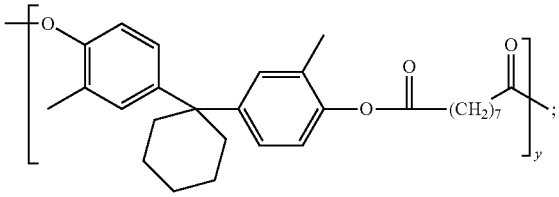
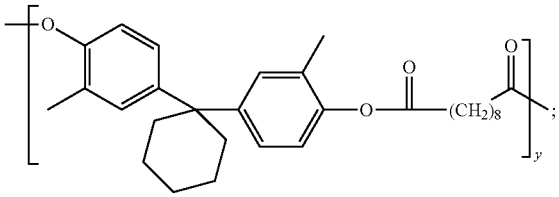
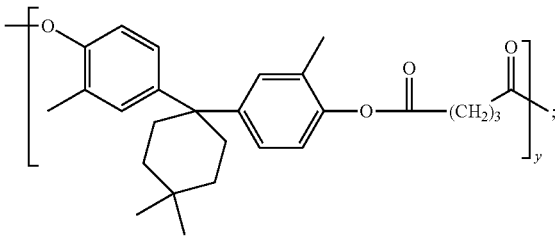

-continued

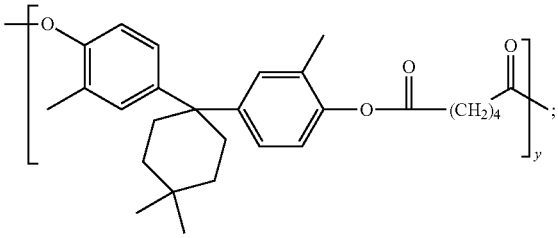

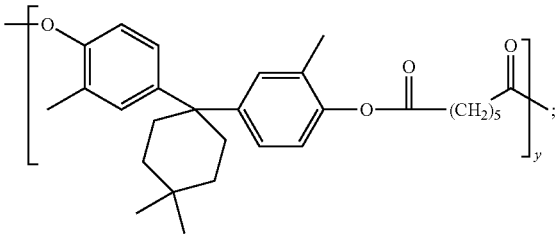

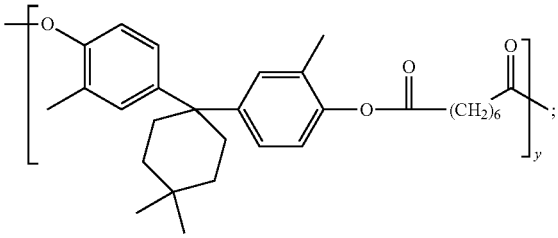

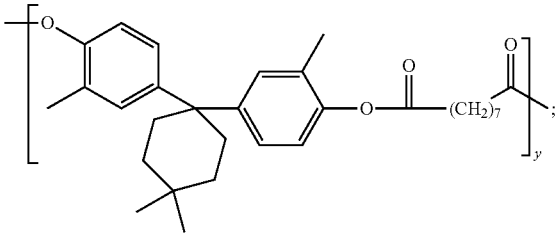

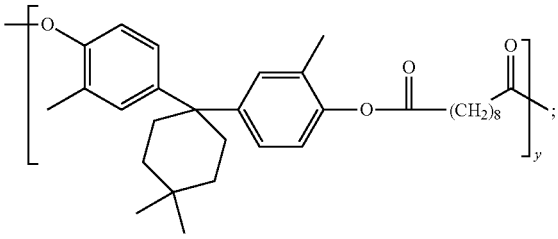

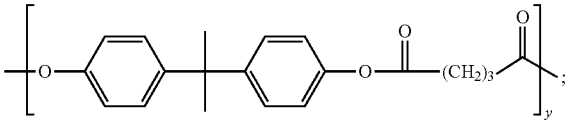

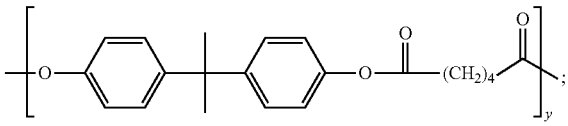

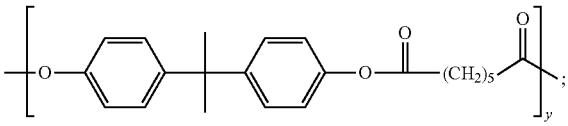

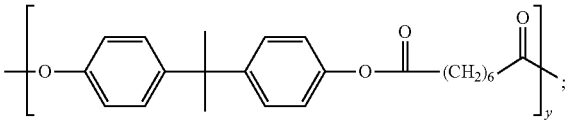

-continued

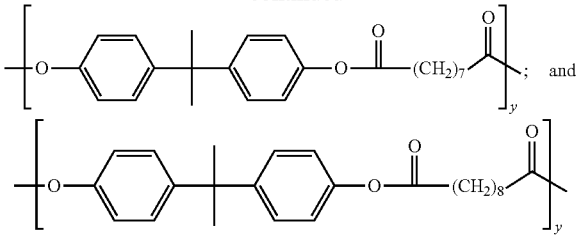

wherein y is 1 to 6.

5. The flexible imaging member of claim 1, wherein the block B organic acid containing repeating unit in the A-B diblock copolymer are derived from an aromatic dicarboxylic acid selected from the group consisting of

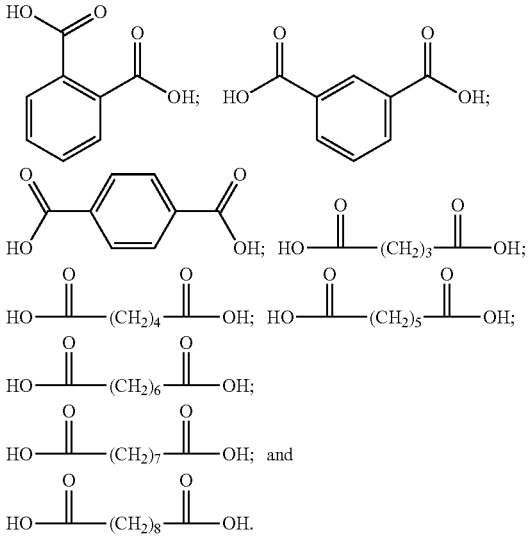

6. The flexible imaging member of claim 1, wherein the bisphenol polycarbonate present in the polymer blend binder is present in a weight ratio amount of the bisphenol polycarbonate to the A-B diblock copolymer of from about 25:75 to about 75:25.

7. The flexible imaging member of claim 1, further including an anticurl back coating positioned on a second side of the substrate opposite to the charge generating layer and the charge transport layer to provide imaging member flatness.

8. The flexible imaging member of claim 1, wherein the charge transport layer comprises multiple layers including at a least a bottom charge transport layer and a top exposed charge transport layer.

9. The flexible imaging member of claim 8, wherein the amount of charge transport component present in the multiple charge transport layers decreases in continuum from the bottom charge transport layer to the top exposed charge transport layer.

10. An image forming apparatus for forming images on a recording medium comprising:

a) an imaging member having a charge retentive-surface for receiving an electrostatic latent image thereon, wherein the imaging member comprises a substrate, a charge generation layer, at least one charge transport layer disposed on the charge generation layer, wherein the charge transport layer comprises a charge transport compound molecularly dispersed or dissolved in a binary polymer blend binder to form a solid solution, the polymer blend binder comprising a bisphenol polycarbonate and an organic acid containing A-B diblock copolymer having a general formula of $$R_1\text{-}(\text{[Block A]}_z\text{-[Block B]}_y)_n\text{OH}$$

wherein block A is a polycarbonate repeating unit, block B is an organic acid containing repeating unit, z is from about 9 to about 54, y is from about 1 to about 6, n is between about 20 and about 80, and $R_1$ is H or $CH_3$ and further wherein a weight ratio of the bisphenol polycarbonate to organic acid containing A-B diblock copolymer can be varied from about 10:90 to about 90:10 to tune photoelectrical function and cyclic stability of the flexible imaging member;

wherein the block A polycarbonate repeating unit in the A-B diblock copolymer is a bisphenol polycarbonate selected from the group consisting of Formula A-6

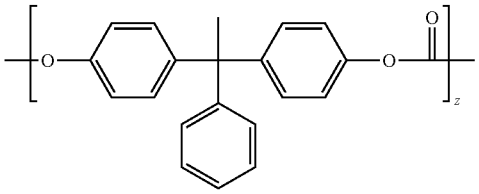

Formula A-7

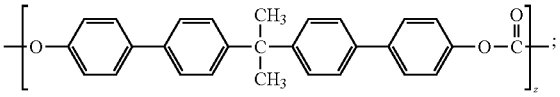

-continued

Formula A-8

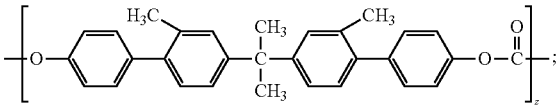

and

Formula A-9

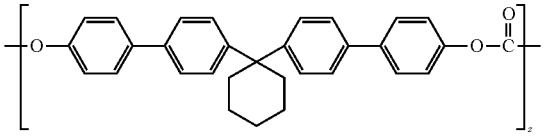

wherein z is an integer representing the numbers of repeating segmental carbonate unit, and is from about 9 to about 18, from about 27 to about 36, or from about 45 to about 54;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

* * * * *